United States Patent [19]

Wachi

[11] 4,393,743

[45] Jul. 19, 1983

[54] ELECTRONIC MUSICAL INSTRUMENTS OF THE TYPE SYNTHESIZING A PLURALITY OF PARTIAL TONE SIGNALS

[75] Inventor: Masatada Wachi, Hamamatsu, Japan

[73] Assignee: Nippon Gakki Seizo Kabushiki Kaisha, Hamamatsu, Japan

[21] Appl. No.: 301,014

[22] Filed: Sep. 10, 1981

[30] Foreign Application Priority Data

Sep. 24, 1980 [JP] Japan ..... 55-133261

[51] Int. Cl.[3] ..... G10H 1/08; G10H 7/00

[52] U.S. Cl. ..... 84/1.23; 84/1.24

[58] Field of Search ..... 84/1.19–1.24

[56] References Cited

U.S. PATENT DOCUMENTS

| | | | |
|---|---|---|---|
| 4,133,242 | 1/1979 | Nagai et al. | 84/1.22 X |
| 4,135,427 | 1/1979 | Deutsch | 84/1.22 |
| 4,205,579 | 6/1980 | Kakehashi | 84/1.24 |
| 4,282,790 | 8/1981 | Wachi | 84/1.21 |
| 4,351,219 | 9/1982 | Bass | 84/1.21 |

FOREIGN PATENT DOCUMENTS

| | | |
|---|---|---|
| 2853209 | 6/1979 | Fed. Rep. of Germany . |
| 2939401 | 3/1980 | Fed. Rep. of Germany . |
| 2945901 | 6/1980 | Fed. Rep. of Germany . |
| 2945518 | 7/1980 | Fed. Rep. of Germany . |
| 55-32028 | 3/1980 | Japan . |

*Primary Examiner*—Stanley J. Witkowski

*Attorney, Agent, or Firm*—Spensley, Horn, Jubas & Lubitz

[57] ABSTRACT

In an electronic musical instrument, where a musical tone signal having a plurality of partial tone components in a predetermined bandwidth is produced by amplitude-modulating a carrier signal according to a time window signal, there is provided a control means which generates a control signal determining orders of partial tone components to be calculated. In accordance with the control signal the frequency of the carrier signal and the time width of the time window signal. This instrument makes it possible to freely select the frequency bandwidth of the calculated partial tone components, thereby producing a musical tone having a variety of tone colors.

13 Claims, 25 Drawing Figures

(C)

ELECTRONIC MUSICAL INSTRUMENTS OF THE TYPE SYNTHESIZING A PLURALITY OF PARTIAL TONE SIGNALS

BACKGROUND OF THE INVENTION

This invention relates to an electronic musical instrument and more particularly an electronic musical instrument of the type for sequencially calculating a plurality of partial tone signals with a plurality of time divisioned time slots such that these partial tone signals are synthesized to form a musical tone signal.

As disclosed in Japanese Preliminary Publication of Patent No. 32028/1980, it has been proposed an electronic musical instrument in which a predetermined time window signal such as a Hanning window signal is multiplied with a predetermined frequency signal (for instance, a sine wave signal) for simultaneously calculating a plurality of partial tone components over a predetermined frequency bandwidth having a predetermined frequency signal as the center component.

According to this electronic musical instrument, however, a waveform prepared by amplitude modulating a predetermined frequency signal with a Hanning window signal is prestored in a memory device and then read out therefrom with an address signal having a period corresponding to the time width of the Hanning window signal, so that the relation between the Hanning window signal and the predetermined frequency signal would be fixed whereby it is impossible to arbitrarily set the frequency bandwidth of a plurality of partial tone components which are calculated simultaneously and to limit kind of tone colors of tones to be produced.

SUMMARY OF THE INVENTION

Accordingly it is an object of this invention to provide a novel electronic musical instrument which can eliminate the difficulty described above and can form arbitrarily a musical tone constituted by a plurality of partial tone components with a simple construction.

To accomplish this object, according to this invention, the frequency signal and the time window signal described above are generated independently, and thereafter the frequency signal is amplitude modulated with the time window signal. Furthermore there is provided a designation means that designates the order (frequency) of a partial tone signal to be calculated in accordance with a set tone color or the like so as to set to any desired values the time width of the time window signal and the frequency of the frequency signal according to the designation by the designation means.

BRIEF DESCRIPTION OF THE DRAWINGS

In the accompanying drawings:

FIGS. 8 through 10*c* show the detail of the timing pulse generator shown in FIG. 1; and its operation.

DESCRIPTION OF THE PREFERRED EMBODIMENT

Figure 1:
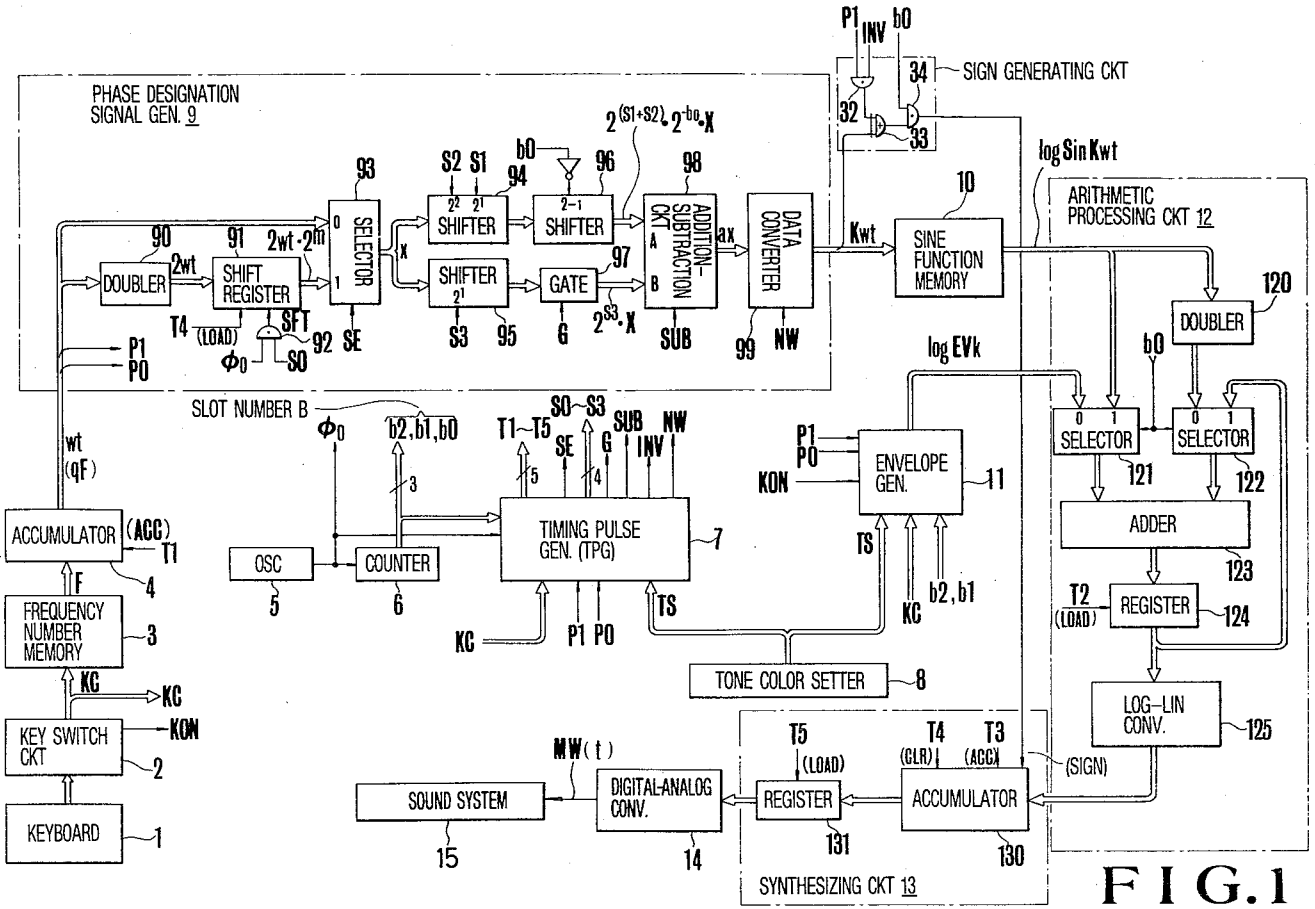
FIG. 1 is a block diagram showing one embodiment of the electronic musical instrument according to this invention.
Figure 2:
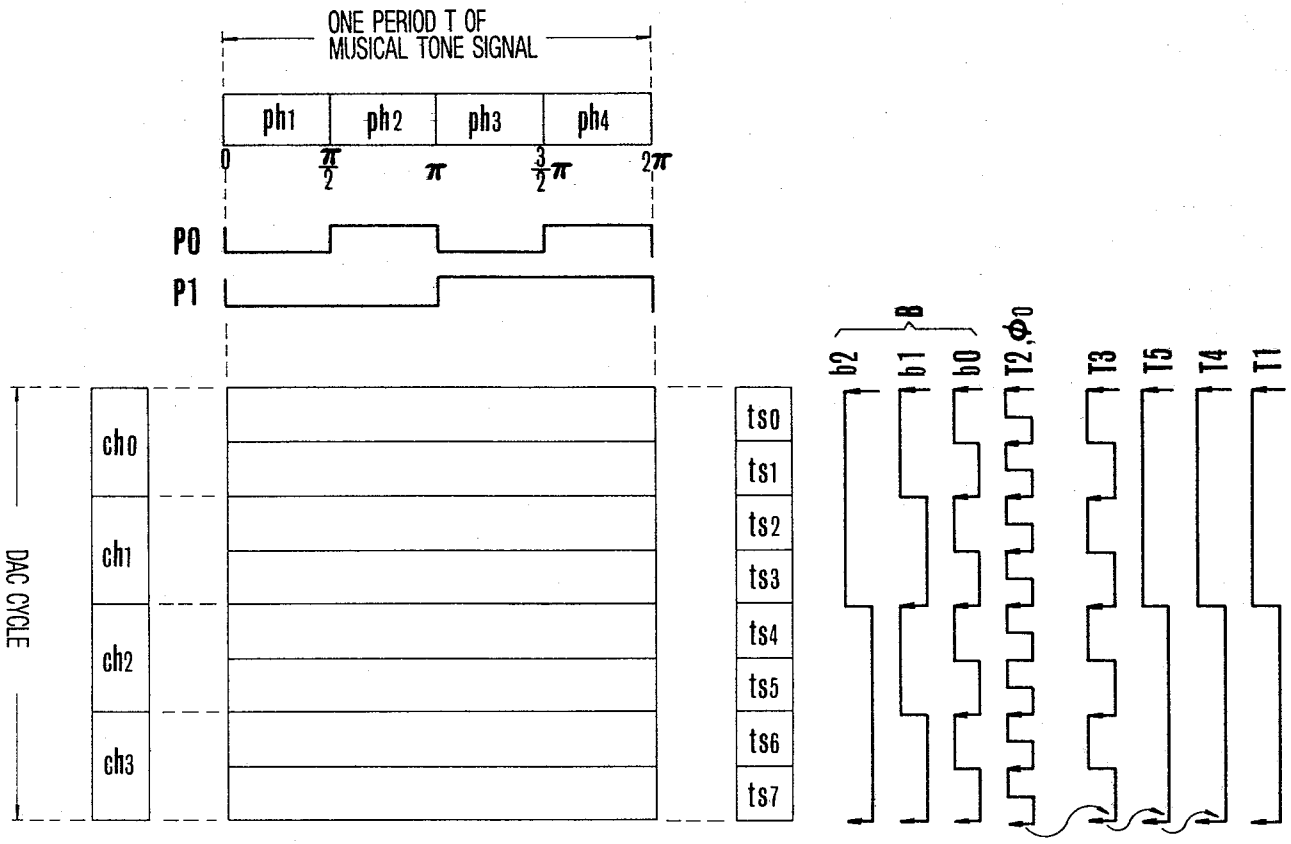
FIG. 2 is a diagram showing the relation between calculating channels for calculating partial tone components and timing pulses.

As shown in FIG. 2, one embodiment of the electronic musical instrument shown in FIG. 1 comprises eight time divisioned time slots ts0 through ts7 of which four pairs of ts0 and ts1; ts2 and ts3; ts4 and ts5; and ts6 and ts7 constitute four partial tone calculating channels ch0 through ch3 which calculate desired partial tone components respectively.

More particularly, in each calculating channel, the fore half time slots (ts0, ts2, ts4 and ts6) produce the time window signal W having desired time width Tw, while the later half time slots (ts1, ts3, ts5 and ts7) produce the kth order frequency signal of a sine waveform having a desired frequency kf (where f represents the frequency of a musical tone signal to be produced and k represents order of a partial tone). Then the time window signal W is multiplied with the kth order frequency signal Hk for calculating partial tone components hkw over a desired bandwidth having the kth order partial tone component hk having a frequency represented by kf as the center component.

In this case, the frequency signal Hk and the time window signal W are generated in the following manner. With regard to the frequency signal Hk, a sine wave signal sin wt (w: angular frequency) of one period (see FIG. 3*a*) is stored in a memory device as a digital value and then a frequency number F corresponding to the tone pitch of a depressed key is sequentially accumulated at a predetermined speed to form an accumulated value gF ($q=1, 2, 3 \ldots$) having a recurrent frequency same as the frequency f of the tone pitch (the frequency f of the musical tone signal) of the depressed key. The accumulated value gF is applied to an address input of the sine function memory device as a phase designation signal of one period of the sine wave to read out the sine wave signal sin wt of frequency f from the sine function memory device, the generated sine wave signal sin wt being utilized as a frequency signal Hk. After multiplying a signal wt with k and the product is then applied to the sine function memory device as an address signal, for producing a frequency signal Hk having a frequency of kf as shown in FIG. 3*c*.

Figure 3:
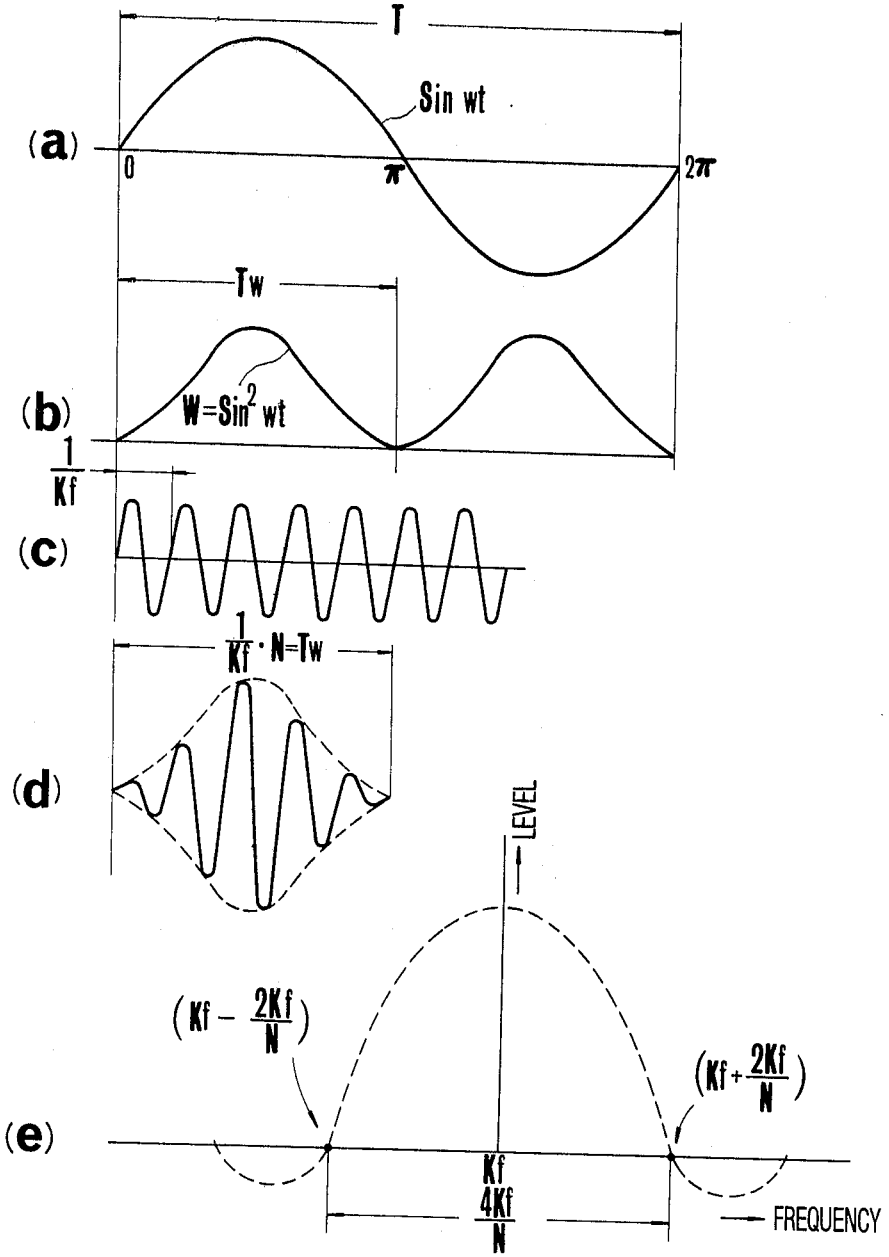
FIGS. 3*a* through 3*e* show waveforms for explaining a method of forming a time window signal and the kth order frequency signal.

With reference to the time window signal W, a signal wt is applied to the sine function memory device as the address signal for reading out the sine wave signal sin wt having a frequency f, and then the sine wave signal sin wt is squared to form a signal $\sin^2$ wt consisting of only positive amplitude components as shown in FIG. 3*b*. The phase portion between 0 to $\pi$ of the signal $\sin^2$ wt is used as the time window signal W. For this reason, the time width Tw of the time window signal W is ½ of one period T of the sine wave signal sin wt. Thus, by varying the period of the sin wave signal sin wt, it is possible to vary the time width Tw of the time window signal W to any value. For example, where signal wt is made to be (wt)/2, Tw becomes to T, whereas when the signal wt is made to be 2 wt, Tw=T/4, and where wt=kwt, Tw=T/(2k). With this control it is possible to cause a single sine function memory device to produce a time window signal W having a desired time width Tw and a frequency signal Hk having a desired frequency kf.

By multiplying the frequency signal Hk thus produced with the time window signal W, in other words by amplitude-modulating the frequency signal Hk as a carrier wave with the time window signal W, an amplitude modulated signal Hkw as shown in FIG. 3*d* can be obtained. It is known that where the time width Tw is made to be equal to N times (N is a positive integer) of the period 1/(kf) of a frequency signal Hk having a frequency of kf the modulated signal Hkw would have a spectrum envelope having a bandwidth (main lobe) of 4/(Tw), that is (4kf)/N as the frequency signal Hk of a frequency kf as the center component as shown in FIG. 3*e*. Thus, it will be noted that the modulated signal Hkw is constituted by a number of frequency components distributed over a frequency bandwidth shown by (4kf)/N. Accordingly, where the modulated signal Hkw is formed as above described and where the constituent frequency components are used as the partial tone components, a plurality of partial tone components can be calculated at the same time. Since the frequency components constituting the modulated signal Hkw are utilized as the partial tone components, in the following description, the modulated signal Hkw is designated as a partial tone component Hkw.

Figure 4:
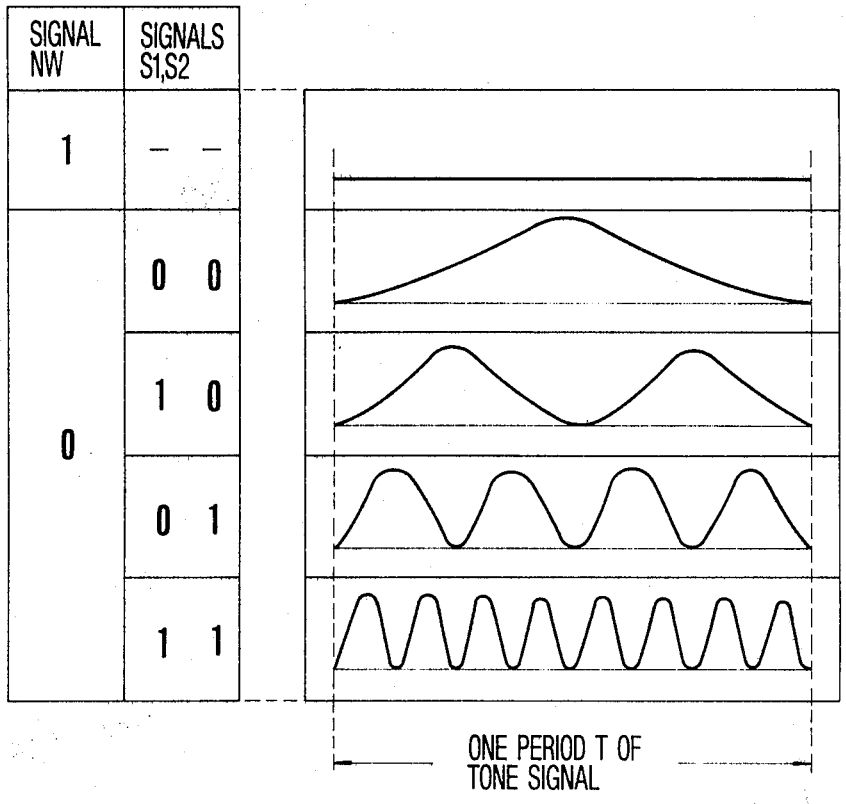
FIG. 4 is a graph for explaining a method of controlling the time width of a time window signal.

The embodiment shown in FIG. 1 is constructed such that the time width Tw of the time window signal W and the frequency kf of the frequency signal Hk are controlled in accordance with the tone color set by a tone color setter and the tone pitch of a depressed key. With regard to the time window signal W, as shown in FIG. 4, a time window signal W having a constant level is produced by controlling signals NW,S1 and S2 to be described later (this is the same as if no time window signal W presents), or a plurality of time window signals W are produced, on the time division basis, in the same calculating channel so as to calculate with the same calculating channel partial tone components hkw over a plurality of groups of frequency bandwidths.

The construction and the operation of the embodiment shown in FIG. 1 will now be described as follows.

The embodiment shown in FIG. 1 comprises a keyboard 1 provided with a plurality of keys, a key switch circuit 2 including a plurality of key switches respectively corresponding to the keys of the keyboard 1 and constructed such that when a certain key is depressed, a key switch corresponding thereto is operated so as to produce a key code KC (comprising an octave code BC representing an octave range and note code NC representing a note name) corresponding to the depressed key, and a key-on signal KON showing that a certain key has been depressed; a frequency number memory device 3 storing in its addresses the frequency numbers F (digital values) corresponding to the tone pitches of respective keys so as to output the frequency number F corresponding to the tone pitch of the depressed key, and an accumulator 4 which sequentially accumulates the frequency number F each time a timing pulse T1 is generated so as to output the accumulated value qF (q=1, 2, 3 . . . ) as a phase designation signal wt for producing a time window signal and partial tone signals. The accumulator 4 is constructed such that the most significant bit signal P1 of the phase designation signal wt outputted therefrom would have the same frequency f (having a period of T=1/f) as a musical tone signal to be formed. Accordingly, the most significant bit signal P1 and the next order bit signal P0 of the phase designation bit signal wt outputted from the accumulator 4 can designate respective phase portions ph1 through ph4 obtained by dividing one period T of the musical tone signal into 4 portions, as shown in FIG. 2. When the phase designation signal wt is applied to a sine function memory device as it is, a first frequency signal H1(=sin wt) of a sine waveform of a frequency f can be obtained, whereas when the signal wt is multiplied with k and then applied to the sine function memory device a kth frequency signal Hk (sin kwt) having a sine waveform of a frequency kf can be obtained.

As shown in FIG. 2, the timing pulse T1 for accumulating the frequency number F is generated by a timing pulse generator 7 (to be described later) each time the time slots ts0 through ts7 circulate one cycle. Accordingly, the phase designation signal wt is updated or changed to a new value each time the time slots ts0 through ts7 (calculating channels ch0 through ch3) make one cycle.

The electronic musical instrument shown in FIG. 1 further comprises an oscillator 5 for producing a clock pulse $\phi$o having a predetermined frequency, a counter 6 which counts the number of the clock pulse $\phi$o for producing a slot number signal B consisting of 3 bit signals b2, b1 and b0 representing the time divisioned time slots ts0 through ts7, and the timing pulse generator 7 which generates various timing pulses (T1, T2, T3, T4, T5, S0, S1, S2, S3, SE, G, INV, NW and SUB) necessary to calculate predetermined partial tone components in the calculating channels ch0 through ch3 corresponding to a set tone color and the tone range of a depressed key in accordance with the clock pulse $\phi$0, the slot number signal B, the key code KC, upper order bit signals P1 and P0 of the phase designation signal wt, and a tone color setting signal Ts representing a tone color selectively set by a tone color setter 8. The relationship among the timing pulses T1 through T5 and the time slots ts0 through ts7 (calculating channels ch0 through ch3) is shown by FIG. 2. The other timing pulses S0 through S3, SE, G, SUB, INV and NW are used to change the phase designation signal wt in accordance with the time width TW of the time window signal W utilized in the calculating channels ch0 through ch3 and the frequency kf of the frequency signal Hf. The number and timings of generation of these timing pulses differ depending upon the set tone color and the tone range of a depressed key. Among various timing pulses, the timing pulse INV becomes "1" in the later half portion of one period of a musical tone signal where the even number ordered partial tone components are eliminated from the musical tone signals formed in respective calculating channels ch0 through ch3 so that musical tone signals containing only the odd number ordered partial tone components are formed. Consequently, musical tone color containing the even and odd number ordered partial tone components is selected, and the timing pulse INV is always "0". The timing pulse NW becomes "1" only when the time window signal W is not produced but a single partial tone component hk is calculated based on the frequency signal HK.

The period in which the time slots ts0 through ts7 (calculating channels ch0 through ch3) circulate constitutes a DAC cycle in which the partial tone components calculated in that period are synthesized and the synthesized value is converted into an instantaneous value MW(t) of an analogue musical tone signal.

There is also provided a phase designation signal generator 9 which changes the phase designation signal wt according to the timing pulses S0 through S3, SE, G, NW and SUB corresponding to the time width Tw of the time window signals W generated in respective calculating channels ch0 through ch3 and the frequency kf of the sine waveform frequency signal Hk. The phase designation signal generator 9 is constituted by a doubler 90, a shift register 91, an AND gate circuit 92, a selector 93, shifters 94 through 96, a gate circuit 97, an addition-subtration circuit 98 and a data converter 99. Respective calculating channels ch0 through ch3 are constructed to change the phase designation signals wt with the timing pulses S0 through S3, . . . SUB, for producing phase designation signals kwt as shown in the following Table I.

TABLE I

| | calculating channel | | | |
|---|---|---|---|---|
| | ch0 | ch1 | ch2 | ch3 |
| phase designation signal kwt | ½ wt | ½ wt | ½ wt | ½ wt |
| | wt | wt | wt | wt |
| | 2 wt | 2 wt | 2 wt | 2 wt |
| | 3 wt | 3 wt | 3 wt | 3 wt |
| | 4 wt | 4 wt | 4 wt | 4 wt |
| | 5 wt | 5 wt | 5 wt | 5 wt |
| | 6 wt | 6 wt | 6 wt | 6 wt |
| | 7 wt | 7 wt | 7 wt | 7 wt |
| | 8 wt | 8 wt | 8 wt | 8 wt |
| | 9 wt | 9 wt | 9 wt | 9 wt |
| | 10 wt | 10 wt | 10 wt | 10 wt |
| | 12 wt | 12 wt | 16 wt | 16 wt |
| | 14 wt | 16 wt | 24 wt | 32 wt |
| | 16 wt | 20 wt | 32 wt | 48 wt |
| | 18 wt | 24 wt | 40 wt | 64 wt |
| | 20 wt | 28 wt | 48 wt | 80 wt |
| | | 32 wt | 56 wt | 96 wt |
| | | 36 wt | 64 wt | 112 wt |
| | | 40 wt | 72 wt | 128 wt |
| | | | 80 wt | 144 wt |
| | | | | 160 wt |

In a time slots among time slots ts0, ts2, ts4 and ts6, in which a time window signal W is generated that is calculating channels ch0 through ch3 in which the least significant bit signal b0 of the slot number signal B is "0", let us assume that the relation between the time width Tw of the time window signal W to be generated and the period T of the musical tone signal is expressed by an equation.

$$Tw = T/(2k) \quad (1)$$

The circuit 9 is constructed to produce a phase designation signal kwt, where $$k = T/(2Tw) \quad (2)$$

so as to read out the sine wave signal stored in the sine function memory device 10 with this phase designation signal.

In this case, although it is possible to set the time width Tw of the time window signal W to any desired value by controlling the phase designation signal kwt, in this embodiment, the time width Tw is limited to those shown in FIG. 4, that is Tw=T, 1/(2T), 1/(4T) and 1/(8T). It is also possible to always generate a phase designation signal of a constant $\alpha$, so as to read out a constant amplitude value from the sine function memory device 10 in order not to form a time window signal W. Time window signal W having such various time width can be obtained by making the timing pulses SE and G to be normally "0" thereby controlling the timings of generating the timing pulses S1, S2 and NW.

At this stage, the operation of the phase designation signal generator 9 will be described briefly.

The phase designation signal wt outputted from the accumulator 4 is applied to an input "0" of the selector 93 and respective bit signals constituting the signal wt are shifted by the doubler 90 one bit toward the upper order bits to become 2 wt which is applied to the shift register 91.

The shift register 91 is loaded with the output signal 2 wt of the doubler 90 when the timing pulse T4 builds down (when the DAC cycle starts) and shifts one bits towards the upper order bits the loaded signal 2 wt each time a shift pulse SFT is applied through the AND gate circuit 92 so as to produce a signal $(2\ wt)\times(2^m)$ formed by multiplying signal 2 wt with $2^m$ according to the number m of generation of the shift pulses SFT. At this time, the number m of generation of the shift pulses SFT is determined by an interval in which the timing pulse S0 is in on "1" state. When this interval corresponds to m periods of the clock pulse $\phi o$, m shift pulses SFT are produced by the AND gate circuit 92. Although the timing pulse So may become "1" over the entire period of the time slots ts0 through ts7, at the time of starting the DAC cycle, since a priority is given to the loading of the signal 2 wt from the doubler 90 the maximum of the number m of generating shift pulse SFT is seven.

For this reason, signals as shown in the following Table II can be obtained from the shift register 91 by controlling the interval in which the timing pulse So is "1".

TABLE II

| number m of generation of shift pulse SFT | output of shift register 91($2wt \cdot 2^m$) |
|---|---|
| m = 0 | 2 wt |
| = 1 | 4 wt |
| = 2 | 8 wt |
| = 3 | 16 wt |
| = 4 | 32 wt |
| = 5 | 64 wt |
| = 6 | 128 wt |
| = 7 | 256 wt |

In this embodiment, the maximum number m of generation of the shift pulse SFT is limited to 3.

The phase designation signal $(2\ wt)\times(2^m)$ outputted from the shift register 91 is applied to an input "1" of the selector 93. Then, the selector 93 selects and outputs the phase designation signal $(2\ wt)\times(2^m)$ applied to its input "1" when the timing pulse SE is "1", whereas when the timing pulse SE is "0" it selects and outputs the phase designation signal wt applied to its "0" input.

Consequently, the selector 93 produces signals as shown in the following Table III under the control of the timing pulse SE.

TABLE III

| timing pulse SE | number m of generation of shift pulse SFT | output of selector 93 |
|---|---|---|
| 0 | — | wt |
| 1 | m = 0 | 2 wt |
| | = 1 | 4 wt |
| | = 2 | 8 wt |
| | = 3 | 16 wt |

By denoting all phase designation signals (wt, 2 wt, 4 wt, 8 wt and 16 wt) outputted from the selector 93 by (x), this phase designation signal (x) is multiplied with $2^{(S1+S2)}$ in the shifter 94 under the control of the timing pulses S1 and S2 to be changed into a phase designation signal $2^{(S1+S2)}$x (x) as shown in the following Table IV, and multiplied with $2^{s3}$ in the shifter 95 under the control of the timing pulse S3 to be changed into phase designation signals $2^{s3}\times(x)$ as shown in the following Table V under the control of the timing pulse S3.

TABLE IV

| timing pulses S2 | timing pulses S1 | output of shifter 94 $2^{(s1+s2)}\times(x)$ |
|---|---|---|
| 0 | 0 | $2^0\times(x)$ |
| 0 | 1 | $2^1\times(x)$ |
| 1 | 0 | $2^2\times(x)$ |
| 1 | 1 | $2^3\times(x)$ |

TABLE V

| timing pulse S3 | output of shifter 95 $2^{s3}\times(x)$ |
|---|---|
| 0 | $2^0\times(x)$ |
| 1 | $2^1\times(x)$ |

Further, the output signal $[2^{(S1+S2)}]$x (x) of the shifter 94 is multiplied with $2^{-b0}$ in the shifter 96 under the control of the least significant signal b0 of the slot number signal B to be changed into phase designation signals $[2^{(s1+s2)}]\times(2^{-b0})\times(x)$ as shown in the following Table VI. In other words, the output signal $2^{(s1+s2)}\times(x)$ of the shifter 94 is multiplied with $\frac{1}{2}$ in a time slot (ts0, ts2, ts4, ts6; signal b0 becomes "0") utilized to generate the time window signal W.

TABLE VI

| slot number signal b0 | output of shifter 96 $[2^{s1+s2}]\times(2^{-b0})\times(x)$ |
|---|---|
| 0 | $[\frac{1}{2}(2^{s1+s2})]\times(x)$ |
| 1 | $[2^{(s1+s2)}]\times(x)$ |

And the output signal $[2^{(s1+s2)}]\times(2^{-b0})\times(x)$ of the shifter 96 is applied to the input A of the addition-subtraction circuit 98.

On the other hand, the output signal $[2^{s3}]\times(x)$ of the shifter 95 is applied to the B input of the addition-subtraction circuit 98 via the gate circuit 97 only when the timing pulse G is "1", where it is added to or subtracted from the signal $[2^{(s1+s2)}]\times(2^{-b0})\times(x)$ supplied to the A input under the control of the timing pulse SUB.

Consequently, the addition-subtraction circuit 98 outputs a phase designation signal ax as shown in the following Table VII. The addition-subtraction circuit 98 excutes a subtraction operation A-B when the timing pulse SUB is "1".

Since this embodiment is constructed such that when the signal b0 is "0", the timing pulse G would be always "0", when the signal b0 is "0" (the time slot in which the time window signal is generated) the output signal $(\frac{1}{2})\times[2^{(s1+s2)}]\times(x)$ of the shifter 96 is outputted as it is through the addition-subtraction circuit 98 to act as the phase designation signal ax.

TABLE VII

| b0 | S1 | S2 | G | S3 | SUB | output ax of addition-subtraction circuit 98 |
|---|---|---|---|---|---|---|
| | 0 | 0 | 0 | 0 | 0 | x |
| | 1 | 0 | 0 | 0 | 0 | 2x |
| | 1 | 0 | 1 | 0 | 0 | 3x (= 2x + x) |
| | 0 | 1 | 0 | 0 | 0 | 4x |
| 1 | 0 | 1 | 1 | 0 | 0 | 5x (= 4x + x) |
| | 0 | 1 | 1 | 1 | 0 | 6x (= 4x + 2x) |
| | 1 | 1 | 1 | 0 | 1 | 7x (8x − x) |
| | 1 | 1 | 0 | 0 | 0 | 8x |
| | 1 | 1 | 1 | 0 | 0 | 9x (= 8x + x) |
| | 1 | 1 | 1 | 1 | 0 | 10x(= 8x + 2x) |
| 0 | 0 | 0 | 0 | — | — | $\frac{1}{2}$x |
| | 0 | 1 | 0 | — | — | 2x |
| | 1 | 0 | 0 | — | — | 2x |
| | 1 | 1 | 0 | — | — | 4x |

The output signal ax of the addition-subtraction circuit 98 is applied to a data converter 99 which is supplied with a timing pulse NW acting as a control signal, so that the data converter 99 produces a constant value $\alpha$ irrespective of the value of the input signal ax so long as the timing pulse NW is "1", whereas when the timing pulse NW is "0" the data converter 99 produces the input signal ax as it is. In this case, the timing pulse NW becomes "1" only in the time slot utilized to generate the time window signal W of a given channel when calculating channels ch0 through ch3 are not utilized to generate the time window signal W (see FIG. 4). Consequently the data converter 99 normally produces the output signal ax of the addition-subtraction circuit 98 as it is as the phase designation signal kwt, whereas when the timing pulse NW becomes "1" in a time slot utilized to generate the time window signal, a constant value $\alpha$ is outputted as the phase designation signal kwt.

Where the number m of the shift pulses SFT outputted from the AND gate circuit 92 is determined as shown in the following Table VIII for respective channels ch0 through ch3, phase designation signals kwt as shown in Table I can be obtained from the addition-subtraction circuit 98 by controlling the generation of the timing pulses S1, S2, S3, G and SUB.

TABLE VIII

| calculating channel | m |
|---|---|
| ch0 | 0 |
| ch1 | 1 |
| ch2 | 2 |
| ch3 | 3 |

Turning back to FIG. 1, there is provided a sine function memory device which stores in its respective addresses sine amplitude values in terms of logarithms at respective sampling points in one period of a sine waveform signal as shown in FIG. 3*a*, and produces a sine amplitude value log (sin kwt) having a phase corresponding to a signal kwt when supplied with a phase designation signal kwt from the phase designation signal generator 9 to act as an address signal.

There is provided an envelope generator 11 which produces a logarithmic envelope signal log EVk adapted to impart an amplitude envelope for respective partial tone components calculated in respective calculating channels ch0 through ch3 based on the upper order bit signals P1 and P2 of the phase designation signal wt, the upper order bit signals b2 and b1, the tone color setting signal TS, the key code KC and the key-on signal KON.

An arithmetic processing circuit 12 is provided for calculating a time window signal amplitude value 2 log (sin kwt) having a waveform as shown in FIG. 3*b* by doubling a sine amplitude value log (sin kwt) outputted from the sine function memory device 10 in the fore half time slots ts0, ts2, ts4 and ts6 of resective calculating channels ch0 through ch3. Further the arithmetic processing circuit 12 adds the sine amplitude value log (sin kwt) outputted from the sine function memory device 10 in the later half time slots (ts1, ts3, ts5 and ts7) of respective calculating channels ch0 through ch3 to the time window signal amplitude value 2 log (sin kwt) for calculating partial tone components distributing over a frequency bandwidth shown by (4 kf)/N and having the frequency kf at the center, and further adds the envelope signal log EVk to the partial tone components hkw for controlling the amplitude envelope. The arithmetic processing circuit 12 is constituted by a doubler 120, selectors 121 and 122, an adder 123, a register 124, and a logarithm-natural number (LOG-LIN) converter 125. In this case, the partial tone component outputted from the LOG-LIN converter 125 for respective calculating channels ch0 through ch3 are expressed by the following equation $$hkw=(\sin {}^2kwt)\times(EVk)\times(\sin kwt) \tag{3}$$

A synthesizer circuit 13 is provided for synthesizing partial tone components hkw respectively calculated in the calculating channels ch0 through ch3. The synthesizer circuit 13 is constituted by an accumulator 130 which sequentially accumulates the partial tone components hkw for respective calculating channels ch0 through ch3 at the time of building down of the timing pulse T3, and a register 131 which is loaded with the accumulated value Σ hkw produced by the accumulator 130 when the timing pulse T5 builds down and holds the loaded accumulated value until a next new accumulated value Σhkw is given. The content of the accumulator 130 is reset or cleared when the timing pulse T4 slightly lagged than the timing pulse T5 builds down and the output Σhkw of the synthesizing circuit 13 is converted into an analogue musical tone signal instantaneous value MW(t) by a digital-analogue converter 14 and then supplied to a sound system 15.

In this embodiment, there is provided a circuit which designates the fact that the polarities of the partial tone components calculated in the later half portion of one period of the musical tone signal should be inverted when the partial tone components are synthesized in each DAC cycle. This circuit comprises an AND gate circuit 32, an exclusive OR gate circuit 33 and an AND gate circuit 34 which are bounded by dotts and dash lines as shown in FIG. 1. When the timing pulse INV is "1" in the later half portion of one period of the musical tone signal in which the most significant bit signal P1 of the phase designation signal wt is "1", as well as the later half time slots of respective calculating channels ch0 through ch3, this circuit inverts the polarity of the most significant bit signal of the phase designation signal kwt outputted from the data converter 99 and applies the inverted signal to a sign bit input of the accumulator 130. Accordingly, the accumulator 130 synthesizes respective partial tone signals after inverting their polarities. When one period of a musical tone signal is considered continuously, only the even number ordered components are eliminated with the result that a musical tone signal consisting of only the odd number ordered components would be produced.

Even in the normal fore half and later half portions, when the signal INV is "0" (that is not inverted), the most significant bit of the signal kwt would be inputted to the sign bit input of the accumulator 130 as it is.

Figure 7:
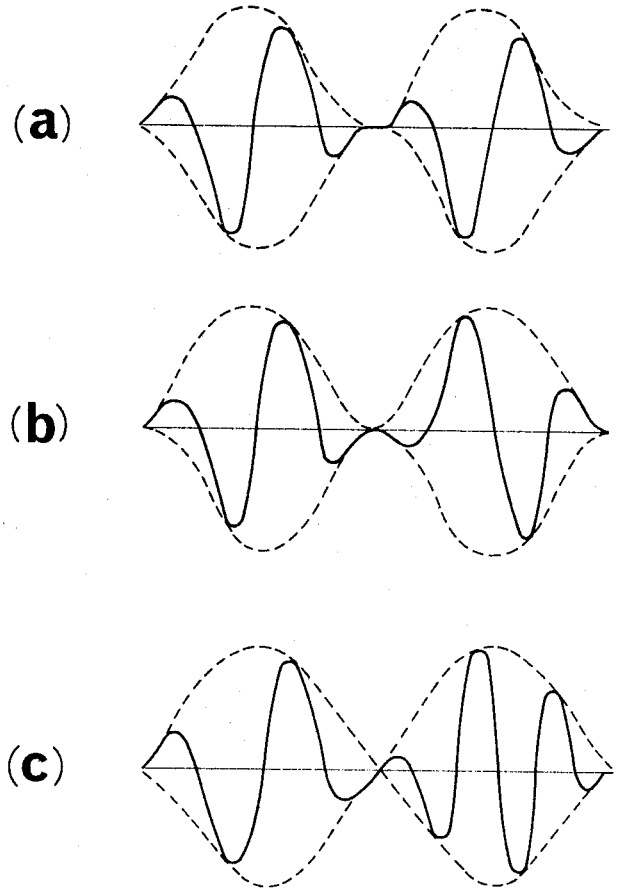
FIG. 7*a* through 7*c* are waveforms for explaining elimination or suppression of even number ordered components.

For example, as shown in FIG. 7*a*, a musical tone signal waveform which is point-symmetrical in the fore half and later half portions of one period of the musical tone signal contains both the even number ordered components and the odd number ordered components. However when the polarity of the later half waveform is inverted, the waveform of the musical tone signal would be shown by FIG. 7*b*. In other words, the waveform of the musical signal tone waveform is line-symmetrical, and the fore half portion of one period is generally expressed by $$\Sigma(An)\times(\sin nwt) \tag{4}$$

while the later half portion by $$-\Sigma(An)\times[\sin(nwt-n\pi)]=-\Sigma(An)\times[(\sin nwt)\times(\cos n\pi)-(\cos nwt)\times(\sin n\pi)]=-\Sigma(An)\times[(\sin nwt)\times(-1)^n]=\Sigma[(-1)^{n+1}]\times(An)\times(\sin nwt) \tag{5}$$

By synthesizing equations (4) and (5), we obtain $$\Sigma(An)\times(\sin nwt)+\Sigma[(-1)^{n+1}]\times(An)\times(\sin nwt)=(A1)\times(\sin wt)+(A2)\times(\sin 2wt)+(A3)\times(\sin 3wt)+(A4)\times(\sin 4wt)+(A5)\times(\sin 5wt)\ldots +(A1)\times(\sin wt)-(A2)\times(\sin 2wt)+(A3)\times(\sin 3wt)-(A4)\times(\sin 4wt)+(A5)\times(\sin 5wt)$$

In this equation, the even number ordered components are eliminated and finally it becomes $$2[(A1)\times(\sin wt)+(A3)\times(\sin 3wt)+(A5)\times(\sin 5wt)\ldots] \tag{6}$$

Consequently, a musical tone signal waveform as shown in FIG. 7*b* is eliminated with even number ordered components, that is it contains only the odd number ordered components. In this case, as shown in FIG. 7*c*, even when the fore and later half portions of one period of the musical tone signal are not perfect line-symmetrical so long as the even number ordered components present in both half portions, by synthesizing the later half portion after inverting its sign the even number ordered components would be suppressed. This is extremely efficient when forming a tone of such pipe instrument as a clarinette.

The operation of the electronic musical instrument constructed as above described is as follows:

After closing a source switch, not shown, the counter 6 and the timing pulse signal generator 7 produce slot number signals B (b2, b1, b0) and timing pulse signals T1 through T5. Under these states, when the performer depresses a key on the keyboard 1 after setting a desired tone color with the tone color setter 8, a frequency number F corresponding to the tone pitch of the depressed key is read out from the frequency number memory device 3. Then, the accumulator 4 sequentially accumulates the read out frequency number F at a period of generating the timing pulse T1, and outputs its accumulated value qF as a phase designation signal wt for producing a time window signal and a sine waveform partial tone signal.

The upper order bit signals P1 and P0 of the phase designation signal wt is applied to the timing pulse generator 7 and to the envelope generator 11 to act as signals for designating the first to the fourth phase portions ph 1 through ph4 formed by dividing one period T of a musical tone signal with 4. Accordingly, the timing pulse generator 7 produces timing pulses S0 through S3, SE, . . . SUB utilized to calculate predetermined partial tone components corresponding to the set tone color and the tone range of the depressed key in respective calculating channels in respective phase portions ph1 through ph4 of one period of the musical tone signal. The phase designation signal wt outputted from the accumulator 4 is changed in the phase designation signal generator 9 under the control of the timing pulses S0 through S3, . . . SUB.

Figure 5:
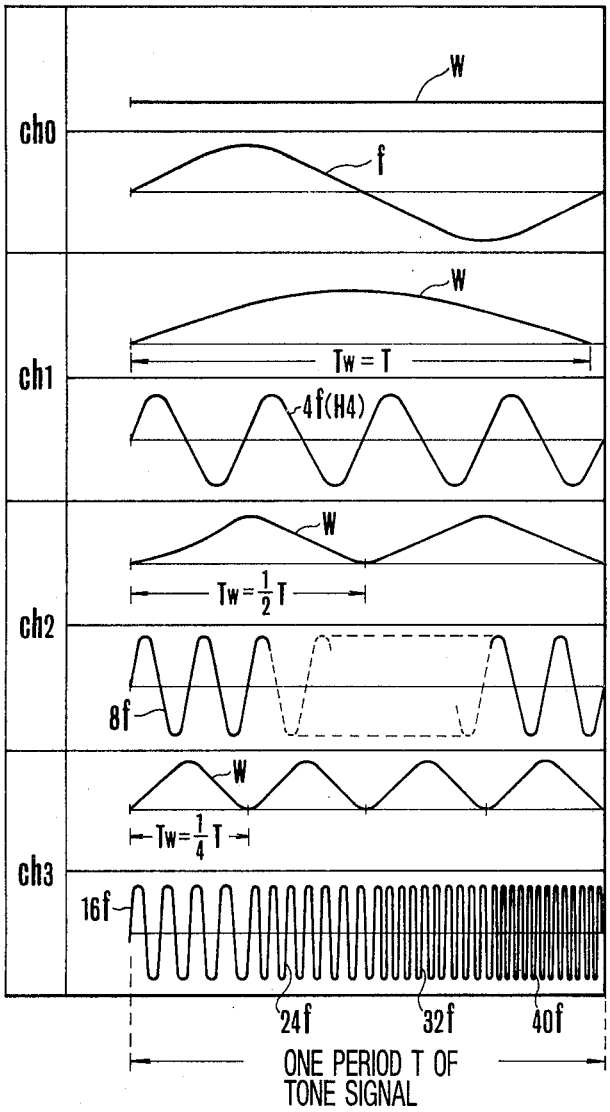
FIG. 5 shows one example of the waveforms of the time window signals and the frequency signals generated in respective calculating channels.

To simplify the description it is assumed that respective calculating channels ch0 through ch3 calculate partial tone components hkw based on a time window signal W and a frequency signal Hk as shown in FIG. 5. More particularly, the calculating channel ch0 calculates the first order partial tone component h1 by multiplying a time window signal W usually at a constant level with a frequency signal H1 having a frequency of f. In the calculating channel ch1, a time window signal W having a time width of Tw=T is multiplied with a frequency signal H4 having a frequency of 4f to calculate a partial tone component h4w, the width M of its main lobe distributing over a frequency bandwidth expressed by $$M=(4)\times(4f)/4$$

and having the fourth order partial tone component h4 (having a frequency of 4f) as the center component.

In the calculating channel ch2, two time window signals W respectively having time widths of $Tw=(\frac{1}{2})\times(T)$ in fore half portion (ph1 and ph2) and later half portion (ph3 and ph4) of one period T of the musical tone signal are produced, and respective time window signals W are multiplied with a frequency signal H8 having a frequency of 8f so as to calculate a partial tone component h8w distributing over a frequency bandwidth and having the 8th order partial tone component h8 (having a frequency of 8f) as the center component, the main lobe width M of the frequency bandwidth being shown by $$M=(4)\times(8f)/4$$

In the calculating channel ch3, a time window signal W having a time width $Tw=(\frac{1}{4})\times(T)$ is produced in each of the phase portion ph1 through ph4 in one period T of the musical tone signal, and the time window signal W in the first phase portion ph1 is multiplied with a frequency signal H16 having a frequency of 16f to calculate a partial tone component h16w distributing over a frequency bandwidth having the 16th order partial tone component h16 as the center component, the main lobe width M of the frequency bandwidth being expressed by an equation $$M=(4)\times(16f)/4$$

whereas the time window signal W in the second phase portion ph2 is multiplied with a frequency signal H24 having a frequency of 24f to calculate a partial tone component h24w distributing over a frequency bandwidth having the 24th order partial tone component h24 as the center component, the main lobe with M of the frequency bandwidth being shown by an equation $$M=(4)\times(24f)/4$$

The time window signal W in the third phase portion ph3 is multiplied with a frequency signal H32 having a frequency of 32f to calculate a partial tone component h32w distributing over a frequency bandwidth having the 32th order partial tone component h32 as the center component, the main lobe width M of the frequency bandwidth being shown by an equation $$M=(4)\times(32f)/8$$

In the same manner, the time window signal W in the fourth phase portion ph4 is multiplied with a frequency signal H40 having a frequency of 40f to calculate a partial tone component h40w distributing over a frequency handwidth having the 40th order partial tone component h40 as the center component, the main lobe width M of the frequency bandwidth being expressed by an equation $$M=(4)\times(40f)/4$$

Where the partial tone component hkw to the calculated in respective calculating channels ch0 through ch3 are those described above, the timing pulse generator 7 produces timing pulses as shown in the following Table 9*a* through 9*d* in the fore and later half time slots of respective calculating channels ch0 through ch3 during an interval between the first to the fourth phase portions ph1 through ph4 of one period T of the musical tone equal.

TABLE IX a

| phase component | calculating channel | time slot | timing pulses S0 | SE | S1 | S2 | S3 | G | SUB | MW | INV |
|---|---|---|---|---|---|---|---|---|---|---|---|
| ph 1 | ch0 | ts0 | 0 | 0 | 0 | 0 | 0 | 0 | 0 | 1 | 0 |
| | | ts1 | 1 | 0 | 0 | 0 | 0 | 0 | 0 | 0 | 0 |
| | ch1 | ts2 | 0 | 0 | 0 | 0 | 0 | 0 | 0 | 0 | 0 |
| | | ts3 | 1 | 0 | 0 | 1 | 0 | 0 | 0 | 0 | 0 |
| | ch2 | ts4 | 0 | 0 | 1 | 0 | 0 | 0 | 0 | 0 | 0 |
| | | ts5 | 1 | 1 | 0 | 0 | 0 | 0 | 0 | 0 | 0 |
| | ch3 | ts6 | 0 | 0 | 0 | 1 | 0 | 0 | 0 | 0 | 0 |
| | | ts7 | 0 | 1 | 0 | 0 | 0 | 0 | 0 | 0 | 0 |

TABLE XI b

| phase component | calculating channel | time slot | timing pulses S0 | SE | S1 | S2 | S3 | G | SUB | NW | INV |
|---|---|---|---|---|---|---|---|---|---|---|---|
| ph 2 | ch0 | ts0 | 0 | 0 | 0 | 0 | 0 | 0 | 0 | 1 | 0 |
| | | ts1 | 0 | 0 | 0 | 0 | 0 | 0 | 0 | 0 | 0 |
| | ch1 | ts2 | 0 | 0 | 0 | 0 | 0 | 0 | 0 | 0 | 0 |

TABLE XI b-continued

| phase component | calculating channel | time slot | S0 | SE | S1 | S2 | S3 | G | SUB | NW | INV |
|---|---|---|---|---|---|---|---|---|---|---|---|
| | | ts3 | 0 | 0 | 0 | 1 | 0 | 0 | 0 | 0 | 0 |
| | ch2 | ts4 | 0 | 0 | 1 | 0 | 0 | 0 | 0 | 0 | 0 |
| | | ts5 | 1 | 1 | 1 | 0 | 0 | 0 | 0 | 0 | 0 |
| | ch3 | ts6 | 0 | 0 | 0 | 1 | 0 | 0 | 0 | 0 | 0 |
| | | ts7 | 1 | 1 | 1 | 0 | 0 | 1 | 0 | 0 | 0 |

TABLE XI c

| phase component | calculating channel | time slot | S0 | SE | S1 | S2 | S3 | G | SUB | NW | INV |
|---|---|---|---|---|---|---|---|---|---|---|---|
| ph 3 | ch0 | ts0 | 0 | 0 | 0 | 0 | 0 | 0 | 0 | 0 | 0 |
| | | ts1 | 0 | 0 | 0 | 0 | 0 | 0 | 0 | 0 | 0 |
| | ch1 | ts2 | 0 | 0 | 0 | 0 | 0 | 0 | 0 | 0 | 0 |
| | | ts3 | 1 | 0 | 0 | 1 | 0 | 0 | 0 | 0 | 0 |
| | ch2 | ts4 | 0 | 0 | 1 | 0 | 0 | 0 | 0 | 0 | 0 |
| | | ts5 | 1 | 1 | 0 | 0 | 0 | 0 | 0 | 0 | 0 |
| | ch3 | ts6 | 0 | 0 | 0 | 1 | 0 | 0 | 0 | 0 | 0 |
| | | ts7 | 1 | 1 | 1 | 0 | 0 | 0 | 0 | 0 | 0 |

TABLE XI d

| phase component | calculating channel | time slot | S0 | SE | S1 | S2 | S3 | G | SUB | NW | INV |
|---|---|---|---|---|---|---|---|---|---|---|---|
| ph 4 | ch0 | ts0 | 0 | 0 | 0 | 0 | 0 | 0 | 0 | 1 | 0 |
| | | ts1 | 0 | 0 | 0 | 0 | 0 | 0 | 0 | 0 | 0 |
| | ch1 | ts2 | 0 | 0 | 0 | 0 | 0 | 0 | 0 | 0 | 0 |
| | | ts3 | 0 | 0 | 0 | 1 | 0 | 0 | 0 | 0 | 0 |
| | ch2 | ts4 | 0 | 0 | 1 | 0 | 0 | 0 | 0 | 0 | 0 |
| | | ts5 | 1 | 1 | 0 | 0 | 0 | 0 | 0 | 0 | 0 |
| | ch3 | ts6 | 0 | 0 | 0 | 1 | 0 | 0 | 0 | 0 | 0 |
| | | ts7 | 1 | 1 | 0 | 1 | 0 | 1 | 0 | 0 | 0 |

Then, in the time slot ts0 of the calculating channel ch0, among the timing pulses S0 through INV, only the pulse NW is "1" over the first to fourth phase portions ph1 through ph4 and the other pulses are all "0". For this reason, the data converter 99 of the phase designation signal generator 9 produces a constant value $\alpha$ as a phase designation signal kwt irrespective of the signal inputted thereto, whereby the sine amplitude value log (sin kwt) outputted from the sine function memory device 10 is also a constant value log (sin $\alpha$). This constant sine amplitude value log (sin $\alpha$) is doubled by the doubler 120 of the arithmetic processing circuit 12 to become (2)×[log (sin $\alpha$)] which is applied to the "0" input of the selector 122. At this time the envelope generator 11 produces an envelope signal log EV1 (k=1) for the partial tone component h1 to be calculated in the calculating channel ch0 and the envelope signal log EV1 is applied to the "0" L input of the selector 121 of the arithmetic processing circuit 12. At this time, since the time slot produces the time window signal W, the least significant bit signal b0 of the slot number signal B is "0", so that the envelope signal log EV1 and the constant sine amplitude value (2)×[log (sin $\alpha$)] supplied to the "0" inputs of the selectors 121 and 122 respectively are selected, outputted and applied to the adder 123 whereby the adder 123 processes the following addition operation.

$$\log EV1+(2)\times[\log(\sin\alpha)]$$

This sum is loaded into the register 124 when the timing pulse T2 builds down, and then fedback to the "1" input of the selecter 122 from the output terminal of the register 124.

Thereafter, in the time slot ts1, timing pulses S0 through INV are all "0". For this reason, various circuits of the phase designating signal generator 9 produce signal as shown in the following Table X.

TABLE X

| circuit | output signal |
|---|---|
| selector 93 | wt |
| shifter 94 | wt |
| shifter 95 | wt |
| shifter 96 | wt |
| gate circuit 97 | 0 |
| addition-subtraction circuit 98 | wt |
| data converter 99 | wt |

Thus, a sine amplitude value log (sin wt) in which k=1 is read out from the sine function memory device 10. More particularly, the first order frequency signal H1 [=log (sin wt)] is outputted and applied to the "1" input of the selector 121 of the arithmetic processing circuit 12. At this time, since the least significant bit signal b0 of the slot number signal B is "1", the selector 121 selects and outputs the first order frequency signal H1 applied to its "1" input. Also the selector 122 selects and outputs the signal [log EV1+(2)×[log (sin $\alpha$)] applied to its "1" input, whereby the adder 123 performs the following addition operation $$[\log EV1+(2)\times[\log(\sin\alpha)]]+\log(\sin wt).$$

This means that the first order frequency signal H1 [=log (sin wt)] is multiplied with the envelope signal EV1. The sum output of the adder 123 is loaded into the register 124 at the time of building down of the timing pulse T2 and then applied to the LOG-LIN converter 125 to be converted thereby into a value "(EV1)×($\chi$)$^2$×(sin wt)" expressed by a natural mumber, and then applied to the accumulator 130 of the synthesizing circuit 13 to be accumulated each time the timing pulse T3 builds down. Consequently, in the calculating channel ch0, the first partial tone component h1 imparted with an envelope is calculated.

In the time slot ts2 of the calculating channel ch1, timing pulses S0 through INV are all "0", and the least significant bit signal b0 of the time slot number signal B is "0".

Accordingly, various circuits of the phase designation signal generator 9 produce signals as shown in the following Table XI.

TABLE IX

| circuit | output signal |
|---|---|
| selector 93 | (wt) |
| shifter 94 | (wt) |
| shifter 95 | (wt) |
| shifter 96 | (wt)/2 |
| gate circuit 97 | 0 |
| addition-subtraction circuit 98 | (wt)/2 |
| data converter 99 | (wt)/2 |

More particularly, in the time slot ts2 the value of the phase designation signal wt of a frequency of f is multiplied with $\frac{1}{2}$ and then outputted. Accordingly, a sine amplitude value log (sin (wt)/2) having a frequency of (wt)/2 is read out from the sine function memory device 10. This sine function amplitude value log (sin (wt)/2) is doubled in the doubler 120 of the arithmetic processing circuit 12 and outputted as a time window signal W as shown in FIG. 3*b*. In this case, the time window signal W has a time width Tw=1/f=T.

This time width signal W having a time width of Tw=T is applied to the adder 123 via the selector 122 to be added to the envelope signal log EV4 (k=4) supplied to the adder 123 via the selector 121, and the sum $$\log Ew4+\log W=\log EV4+(2)\times[\log(\sin(wt)/2)]$$

is temporarily stored in the register 124.

In the next time slot ts3, the timing pulses S0 and S2 become "1" so that various circuits of the phase designation signal circuit 9 produce signals as shown in the following Table XII.

TABLE XII

| circuit | output signal |
|---|---|
| selector 93 | wt |
| shifter 94 | 4 wt |
| shifter 95 | wt |
| shifter 96 | 4 wt |
| gate circuit 97 | 0 |
| addition-subtraction circuit 98 | 4 wt |
| data converter 99 | 4 wt |

Thus, a sine amplitude valve log (sin 4wt) in which k=4 would be read out of the sine function memory device 10 thereby producing the fourth order frequency number signal H4[=log (sin 4wt)] which is added to the signal [log EV4+(2)×[log sin wt/2)]] temporarily stored in the register 124 of the arithmetical processing circuit 12. Accordingly, the fourth order frequency signal H4[=log (sin 4wt)] is multiplied with the envelope signal EV4 and the time window signal w having a time width of Tw=T.

Accordingly, in this calculating channel ch1, a signal obtained by amplitude modulating the first order frequency signal H1 with the time window signal W having a time width of Tw=T and with the envelope signal EV4. In other words, it is possible to obtain a partial tone component h4w distributing over a frequency bandwidth having the first order partial tone component h4 as the center component and an envelope width M expressed by an equation $$M=(4)\times(4f)/4$$

The output [log EV4+(2)×(log (wt/2)+log (sin 4wt)] of the adder 123 is applied to the LOG-LIN converter 125 through the register 124, and after being converted into a value [(EV4)×(sin$^2$ (wt)/2)×(sin 4wt)] terms of a natural number it is applied to the accumulator 130 of the synthesizing circuit 13 to be synthesized with the first order partial tone component h1 calculated in the previous calculating channel ch0.

In the calculating channels ch2 and ch3 predetermined partial tone components hkw are calculated in the same manner. Various signals outputted in this case are shown in the following Tables XIII through XVII. Although detailed description thereof is believed unnecessary regarding the calculating channels, the operatios are different for phase portions ph1 through ph4.

TABLE XIII

[calculating channel ch2]

| circuit | output signal ts 4 | output signal ts 5 |
|---|---|---|
| shift register 91 | 4 wt | 8 wt |
| selector 93 | wt | 8 wt |
| shifter 94 | 2wt | 8 wt |
| shifter 95 | wt | 8 wt |
| shifter 96 | wt | 8 wt |
| gate circuit 97 | 0 | 0 |
| addition-subtraction circuit 98 | wt | 8 wt |
| data converter 99 | wt | 8 wt |
| sine function memory | log (sin wt) | log (sin 8 wt) |
| envelope generator 11 | log EV8 | log EV8 |
| doubler 120 | (2) × [log (sin 2 wt)] | — |
| adder 123 | log EV8 + (2) × [log (sin 2 wt)] | log EV8 + (2) × [log (sin 2 wt)] + log (sin 8 wt) |
| register 124 | log EV8 + (2) × [log (sin 2 wt)] | log EV8 + (2) × [log (sin 2 wt)] + log (sin 8 wt) |
| LOG-LIN converter 125 | | (EV8) × (sin$^2$ wt) × (sin 8 wt) |

TABLE XIV

[phase portion ph1 of calculating channel ch3]

| circuit | output signal ts 6 | output signal ts 7 |
|---|---|---|
| shift register 91 | 16 wt | 16 wt |
| selector 93 | wt | 16 wt |
| shifter 94 | 4 wt | 16 wt |
| shifter 95 | wt | 16 wt |
| shifter 96 | 2 wt | 16 wt |
| gate circuit 97 | 0 | 0 |
| addition-subtraction circuit 98 | 2 wt | 16 wt |
| data converter 99 | 2 wt | 16 wt |
| sine function memory | log (sin 2 wt) | log (sin 16 wt) |
| envelope generator 11 | log EV16 | log EV16 |
| doubler 120 | (2) × [log (sin 2 wt)] | — |
| adder 123 | log EV16 + (2) × [log (sin 2 wt)] | log EV16 + (2) × [log (sin 2 wt)] + log (sin 16 wt) |
| register 124 | log EV16 + (2) × [log (sin 2 wt)] | log EV16 + (2) × [log (sin 2 wt)] + log (sin 16 wt) |
| LOG-LIN converter 125 | | (EV16) × (sin$^2$ 2 wt) × (sin 16 wt) |

TABLE XV

[phase portion ph2 of calculating channel ch3]

| circuit | output signal ts 6 | output signal ts 7 |
|---|---|---|
| shift register 91 | 4 wt | 8 wt |
| selector 93 | wt | 8 wt |
| shifter 94 | 4 wt | 16 wt |
| shifter 95 | wt | 8 wt |
| shifter 96 | 2 wt | 16 wt |
| gate circuit 97 | 0 | 8 wt |
| addition-subtraction circuit 98 | 2 wt | 24 wt |
| data | | |

TABLE XV-continued

[phase portion ph2 of calculating channel ch3]

| circuit | output signal ts 6 | ts 7 |
|---|---|---|
| converter 99 | 2 wt | 24 wt |
| sine function memory | log (sin 2 wt) | log (sin 24 wt) |
| envelope generator 11 | log EV24 | log EV24 |
| doubler 120 | (2) × [log (sin 2 wt)] | — |
| adder 123 | log EV24 + (2) × [log (sin 2 wt)] | log EV24 + (2) × [log (sin 2 wt)] + log (sin 24 wt) |
| register 124 | log EV24 + (2) × [log (sin 2 wt)] | log EV24 + (2) × [log (sin 2 wt)] + log (sin 24 wt) |
| LOG-LIN converter 125 | | (EV24) × ($\sin^2$ 2 wt) × (sin 24 wt) |

TABLE XVI

[phase portion ph3 of calculating channel ch3]

| circuit | output signal ts 6 | ts 7 |
|---|---|---|
| shift register 91 | 16 wt | 16 wt |
| selector 93 | wt | 16 wt |
| shifter 94 | 4 wt | 32 wt |
| shifter 95 | wt | 16 wt |
| shifter 96 | 2 wt | 32 wt |
| gate circuit 97 | 0 | 0 |
| addition-subtraction circuit 98 | 2 wt | 32 wt |
| data converter 99 | 2 wt | 32 wt |
| sine function memory | log (sin 2 wt) | log (sin 32 wt) |
| envelope generator 11 | log EV32 | log EV32 |
| doubler 120 | (2) × [log (sin 2 wt)] | — |
| adder 123 | log EV32 + (2) × [log (sin 2 wt)] | log EV32 + (2) × [log (sin 2 wt)] + log (sin 32 wt) |
| register 124 | log EV32 + (2) × [log (sin 2 wt)] | log EV32 + (2) × [log (sin 2 wt)] + log (sin 32 wt) |
| LOG-LIN converter 125 | | (EV32) × ($\sin^2$ 2 wt) × (sin 32 wt) |

TABLE XVII

[phase portion ph4 of calculating channel ch3]

| circuit | output signal ts 6 | ts 7 |
|---|---|---|
| shift register 91 | 16 wt | 8 wt |
| selector 93 | wt | 8 wt |
| shifter 94 | 4 wt | 32 wt |
| shifter 95 | wt | 8 wt |
| shifter 96 | 2 wt | 32 wt |
| gate circuit 97 | 0 | 0 |
| addition-subtraction circuit 98 | 2 wt | 40 wt |
| data converter 99 | 2 wt | 40 wt |
| sine function memory | log (sin 2 wt) | log (sin 40 wt) |
| envelope generator 11 | log EV40 | log EV40 |
| doubler 120 | (2) × [log (sin 2 wt)] | — |
| adder 123 | log EV40 + (2) × [log (sin 2 wt)] | log EV40 + (2) × [log (sin 2 wt)] + log (sin 40 wt) |
| register 124 | log EV40 + (2) × [log (sin 2 wt)] | log EV40 + (2) × [log (sin 2 wt)] + log (sin 40 wt) |
| LOG-LIN converter 125 | | (EV40) × ($\sin^2$ 2 wt) × (sin 40 wt) |

Figure 6:
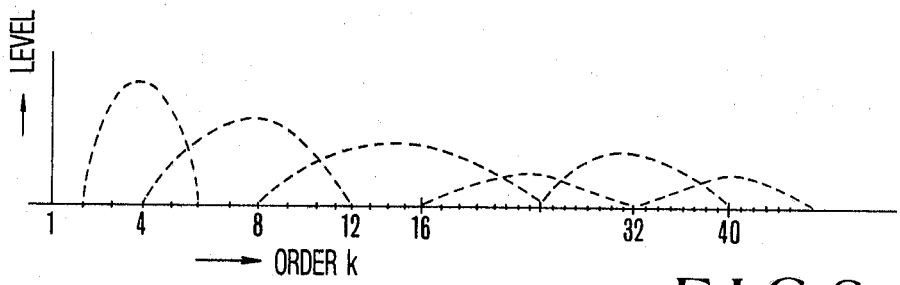
FIG. 6 is a spectrum diagram of the partial tone components calculated by using the time window signals and the frequency signals shown in FIG. 5.

The partial tone components h1, h4w, h8w, h16w, h24w, h32w and h40w calculated in a manner described above are synthesized in the synthesizing circuit 13 at each DAC cycle, and the synthesized value is converted into an analogue musical tone signal instantaneous value Mw (t) in the digital-analogue converter 14 and then supplied to the sound system 15, whereby it produces a tone signal imparted with a spectrum envelope as shown in FIG. 6.

As above described in the electronic musical instrument of this embodiment, since a single sine function memory device is used on the time division basis to generate time window signals and partial tone signals it is possible to calculate partial tone components hkw distributed over a wide frequency bandwidth with extremely simple construction. Moreover, since the amplitude modulation is effected by a logarithmic addition operation for calculating such partial tone components as hkw it is possible to shorten the calculation time. Moreover since the time window signal W is formed by doubling the sine wave signal amplitude value, it is possible to greatly simplify the circuit necessary to calculate the window signal. Especially, since the partial tone components formed by respective calculating channels ch0 through ch3 can change the timing pulses generated by the timing pulse SE, . . . , NW generator 7 in accordance with the set tone color or the like, the respective calculating channels can form the partial tone components at any frequency bandwidth thus enabling to generate a musical tone with any desired tone color.

The detail of the timing pulse generator 7 and the envelope generator 11 will now be described.

Figure 8:
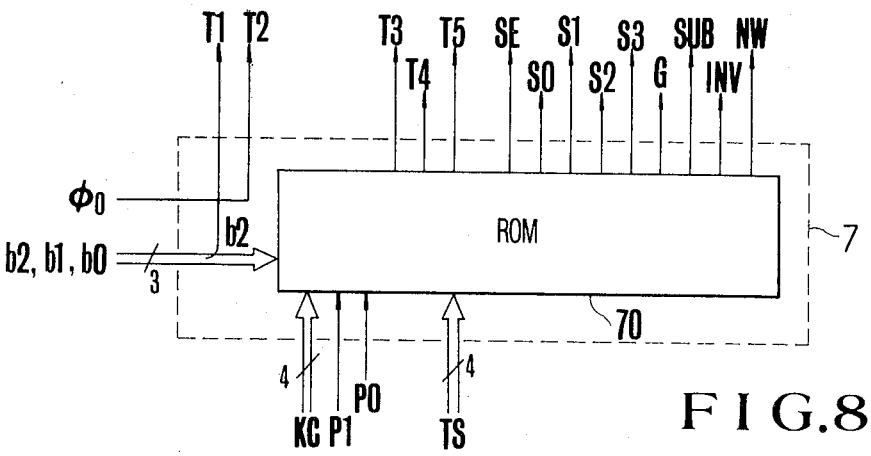

The timing pulse generator 7 is constituted by a read only member device (ROM) 70, for example, as shown in FIG. 8. The ROM 70 has a plurality of memory blocks MB designated by a tone color setting signal TS and a key code KC. Respective memory blocks MB store timing pulses T3 through T5, SE, S0 through S3, G, SUB, INV and NW for generating predetermined time window signals W or the frequency signals Hk in respective time slots ts0 through ts7 designated by signals b2, b1 and b0 and signals P1 and P0 corresponding to the set tone color and the tone range of a depressed key.

Consequently, where a tone color setting signal TS, a key code KC, signals b2, b1 and b0 and signals P1 and P0 are applied as address signals, timing pulses T3 through T5, . . . NW corresponding to the set tone color and the tone range of the depressed key (identified by the key code KC) are produced in synchronism with the partial tone calculating timings of respective calculating channels ch0 through ch3. As can be noted from FIG. 2, although the timing pulses T1 and T2 are the same as signals b2 and @0, they are designated by different signal names.

When the upper order four bits of the key code KC is inputted to the ROM 70 and when the tone color setting signal TS comprises 4 bits, since the types of the timing pulses are 10 (10 bits), the ROM 70 is required to have memory capacity of $(2^{13})\times(10)=80K$ bits, thus considerably increasing the memory capacity.

Figure 9:
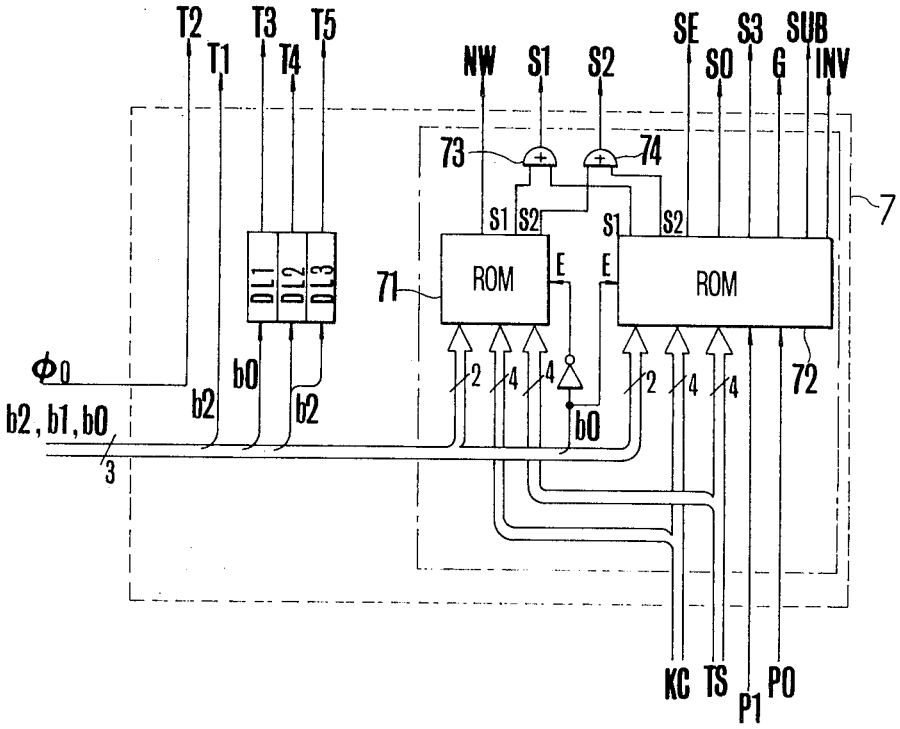

As can be noted from FIG. 2, the timing pulses T3, T4 and T4 may be formed by slightly delaying signals b0 and b2, so that as shown in FIG. 9, signal b0 is delayed with the delay circuit DL1 to form the timing pulse T3, while the signal b2 is delayed by the delay circuit DL2 to form the timing pulse T4 and the signal b2 is delayed by the delay circuit DL3 to form the timing pulse T5. Denoting the delay times of delay circuits DL1 through DL3 by $\tau 1$, $\tau 2$ and $\tau 3$ respectively, the delay times are set to satisfy a relation $\tau 1<\tau 3<\tau 2$.

Regarding other timing pulses, they are divided into a first group consisting of the timing pulses NW, S1 and S2 necessary to generate time window signals W, and a second group consisting of timing pulses S0, S1, S2, S3, SE, G, SUB and INV necessary to generate frequency signals Hk. The circuit is constructed such that the timing pulses belonging to the first group is outputted from the first ROM 71 enabled when the signal b0 is "0", whereas the timing pulses belonging to the second group are generated from the second ROM 72 enabled when the signal b0 is "1". Since timing pulses S1 and S2 belong to both first and second groups they are outputted via OR gate circuits 73 and 74.

With this construction, since the address signal has a total of 10 bits, and the output signal has 3 bits, the memory capacity of the first ROM 71 is $(2^{10})\times(3)$ bits. Furthermore, since the address signal has a total of 12 bits and the output signal has 8 bits the memory capacity of the second ROM 72 is $(2^{12})\times(8)$ bits. It should be noted that this memory capacity is about $\frac{1}{2}$ of that shown in FIG. 8.

Figure 10:
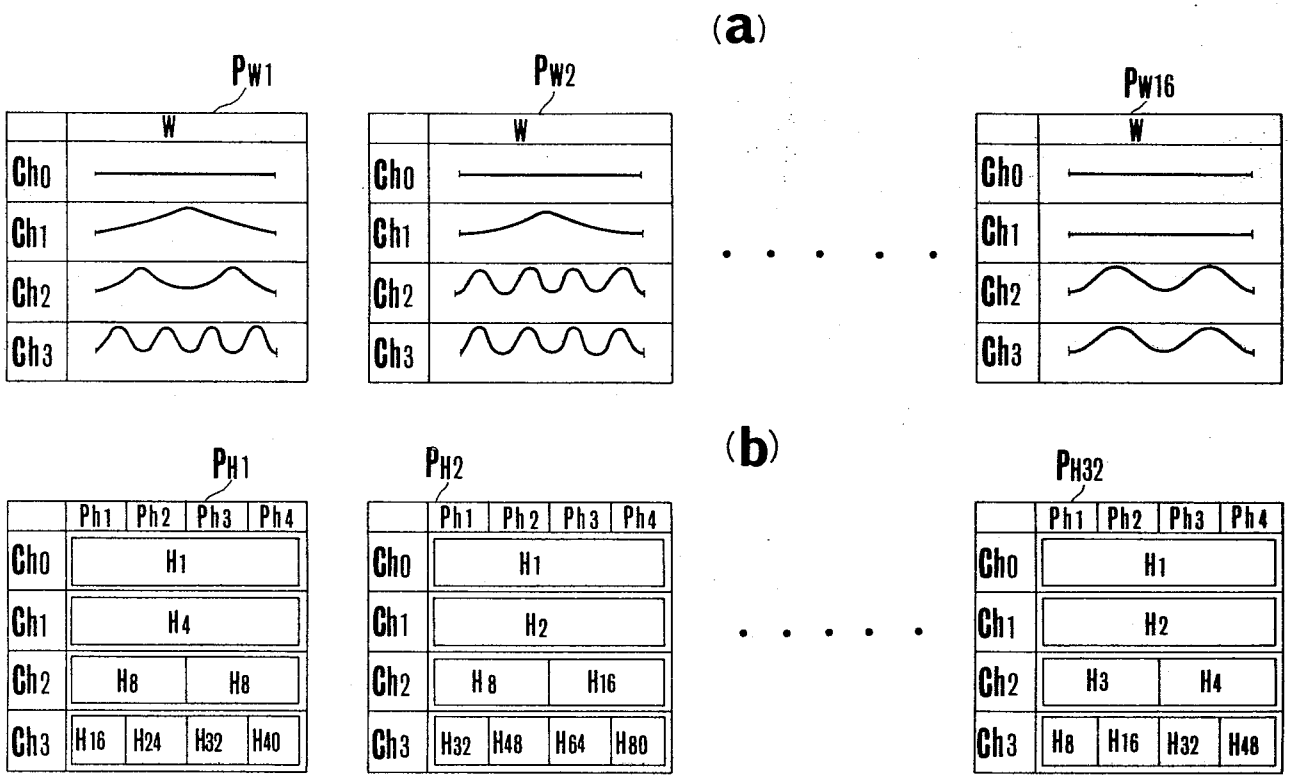
Figure 10:
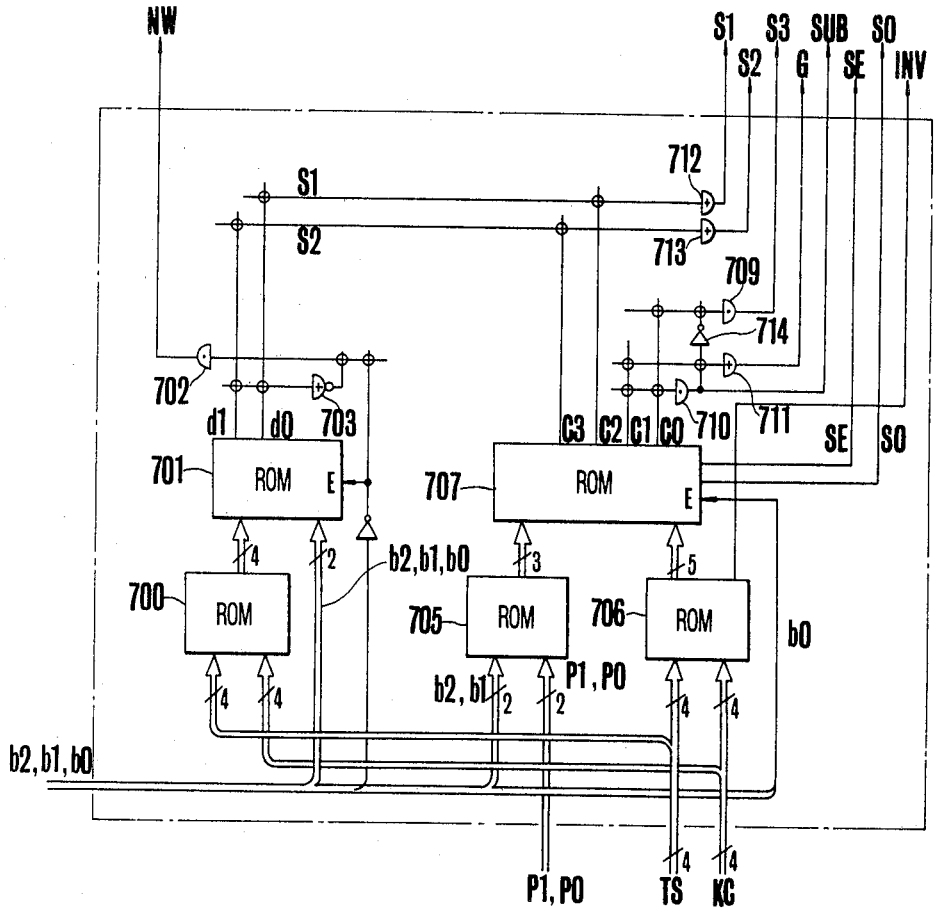

The memory capacity can be further reduced where the types of the time window patterns Pw produced in the calculating channels ch0 through ch3 is limited to 16 as shown by FIG. 10*a* for a tone color designatable by a combination of a key code KC and a tone color setting information TS and by setting the frequency signals Hk produced in respective calculating channels ch0 through ch3 to be 8 frequencies designatable by a combination of the key code KC and the tone color setting information TS so as to cause combinations of these 8 frequencies to form 32 tone color components of patterns PH1 through PH32 as shown in FIG. 10*b*.

The circit shown in FIG. 10*c* is designed on the preset conditions described above and corresponds to a circuit portion including the first and second ROMs 71 and 72 and the OR gate circuits 73 and 74 shown in FIG. 9. In FIG. 10*c* a first ROM 700 produces a 4 bit signal that designates one of the time window pattern designated by the combination of the key code KC and the tone color setting signal TS among 16 types of the time window patterns $P_{w1}$ through $P_{w16}$. This 4 bit signal outputted from the first ROM 700 is applied to the second ROM 701 together with the signals b2 and b1 that designate the calculating channels as an address signal.

The second ROM 701 stores in its addresses 2 bit signals d1 and d0 adapted to form timing pulses NW, S1 and S2 utilized to designate the type of the time window signals W as shown in FIG. 4, and is enabled only when signal b0 is "0". more particularly, the second ROM 701 produces two bit signals d1 and d0 adapted to form a time window pattern (one of Pw1 through Pw16) designated by a set tone color (based on the key code KC and the tone color setting signal TS) for each of the calculating channels ch0 through ch3. These two bit signals d1 and d0 are decoded by an AND gate circuit 702 and an NOR gate circuit 703 to be outputted as timing pulses S1, S2 and NW.

The third ROM 705 is addressed by signals b2 and b1 representing the calculating channels ch0 through ch3 and signals p1 and p0 representing phase positions ph1 through ph4 in one period of the musical tone signal so that at respective phase portions ph1 through ph4, respective calculating channels ch0 through ch3 produce 3 bit signals as shown in the following Table XVIII which designate that which one of the frequency should be calculated among 8 frequencies frequency signals Hk of the frequency combination pattern (PH1 through PH32, shown in FIG. 10*b*).

TABLE XVIII

| Address | | | | | Output | | |
|---|---|---|---|---|---|---|---|
| b2, | b1 | p1, | p0 | | | | |
| | | 0 | 0 | (ph1) | 0 | 0 | 0 |
| 0 | 0 | 0 | 1 | (ph2) | 0 | 0 | 0 |
| | (ch0) | 1 | 0 | (ph3) | 0 | 0 | 0 |
| | | 1 | 1 | (ph4) | 0 | 0 | 0 |
| | | 0 | 0 | (ph1) | 0 | 0 | 1 |
| 0 | 1 | 0 | 1 | (ph2) | 0 | 0 | 1 |
| | (ch1) | 1 | 0 | (ph3) | 0 | 0 | 1 |
| | | 1 | 1 | (ph4) | 0 | 0 | 1 |
| | | 0 | 0 | (ph1) | 0 | 1 | 0 |
| 1 | 0 | 0 | 1 | (ph2) | 0 | 1 | 0 |
| | (ch2) | 1 | 0 | (ph3) | 0 | 1 | 1 |
| | | 1 | 1 | (ph4) | 0 | 1 | 1 |
| | | 0 | 0 | (ph1) | 1 | 0 | 0 |
| 1 | 1 | 0 | 1 | (ph2) | 1 | 0 | 1 |
| | (ch3) | 1 | 0 | (ph3) | 1 | 1 | 0 |
| | | 1 | 1 | (ph4) | 1 | 1 | 1 |

The fifth PROM 706 outputs a 5 bit signal representing a frequency combination pattern (one of PH1 through PH32) corresponding to a tone color designated by the combination of a key code KC and a tone color setting signal TS as well as a timing pulse INV for erasing odd number ordered components of the musical tone signal.

The output signals outputted from the third and fifth ROMs 705 and 706 are applied to the fourth ROM 707 as address signals. However, the timing signal INV is supplied to the outside as it is.

The fourth ROM 707 produces signals C3, C2, C1, C0 and timing pulses SE, SO for forming a frequency signal Hk designated by a 3 bit signal given from the third ROM 705 among frequency signals Hk of 8 frequencies of the generating pattern (one of PH1 through PH32) of the frequency signal Hk designated by the 5 bit signal supplied from the fifth ROM 706.

4 bit output signals C3 through C0 of the fourth ROM 707 are used to prepare timing pulses S1, S2, S3, G, SUB and these four bit signals are decoded as shown in the following Table XIX in a circuit comprising AND gate circuits 709 and 710, OR gate circuits 711 through 713 and an inverter 714 and are outputted as the timing pulses which function in the same manner as the signals S1 through SUB shown in Table VII.

TABLE XIX

| Output of fourth ROM 707 | | | | Timing pulses | | | | | Remarks |
|---|---|---|---|---|---|---|---|---|---|
| C3 | C2 | C1 | C0 | S1 | S2 | G | S3 | SUB | ax |
| 0 | 0 | 0 | 0 | 0 | 0 | 0 | 0 | 0 | x |
| 0 | 1 | 0 | 0 | 1 | 0 | 0 | 0 | 0 | 2x |
| 0 | 1 | 1 | 0 | 1 | 0 | 1 | 0 | 0 | 3x |
| 1 | 0 | 0 | 0 | 0 | 1 | 0 | 0 | 0 | 4x |
| 1 | 0 | 1 | 0 | 0 | 1 | 1 | 0 | 0 | 5x |
| 1 | 0 | 1 | 1 | 0 | 1 | 1 | 1 | 0 | 6x |
| 1 | 1 | 0 | 1 | 1 | 1 | 1 | 0 | 1 | 7x |

TABLE XIX-continued

| Output of fourth ROM 707 | | | | Timing pulses | | | | | Remarks |
|---|---|---|---|---|---|---|---|---|---|
| C3 | C2 | C1 | C0 | S1 | S2 | G | S3 | SUB | ax |
| 1 | 1 | 0 | 0 | 1 | 1 | 0 | 0 | 0 | 8x |
| 1 | 1 | 1 | 0 | 1 | 1 | 1 | 0 | 0 | 9x |
| 1 | 1 | 1 | 1 | 1 | 1 | 1 | 1 | 0 | 10x |

With the construction described above, the memory capacities of the first to sixth ROMs 700 through 708 become to those shown in the following Table XIX showing decrease of the memory capacities than in the case shown in FIG. 9.

TABLE XX

| | address signal | output signal | memory capacity (bits) |
|---|---|---|---|
| first ROM | 8 bits | 4 bits | $(2^8) \times (4) = 1024$ |
| second ROM | 6 bits | 2 bits | $(2^6) \times (2) = 128$ |
| third ROM | 4 bits | 3 bits | $(2^4) \times (3) = 48$ |
| fourth ROM | 8 bits | 4 bits | $(2^8) \times (4) = 1024$ |
| fifth ROM | 8 bits | 6 bits | $(2^8) \times (6) = 1536$ |
| sixth ROM | 9 bits | 2 bits | $(2^9) \times (2) = 1024$ |

Figure 11:
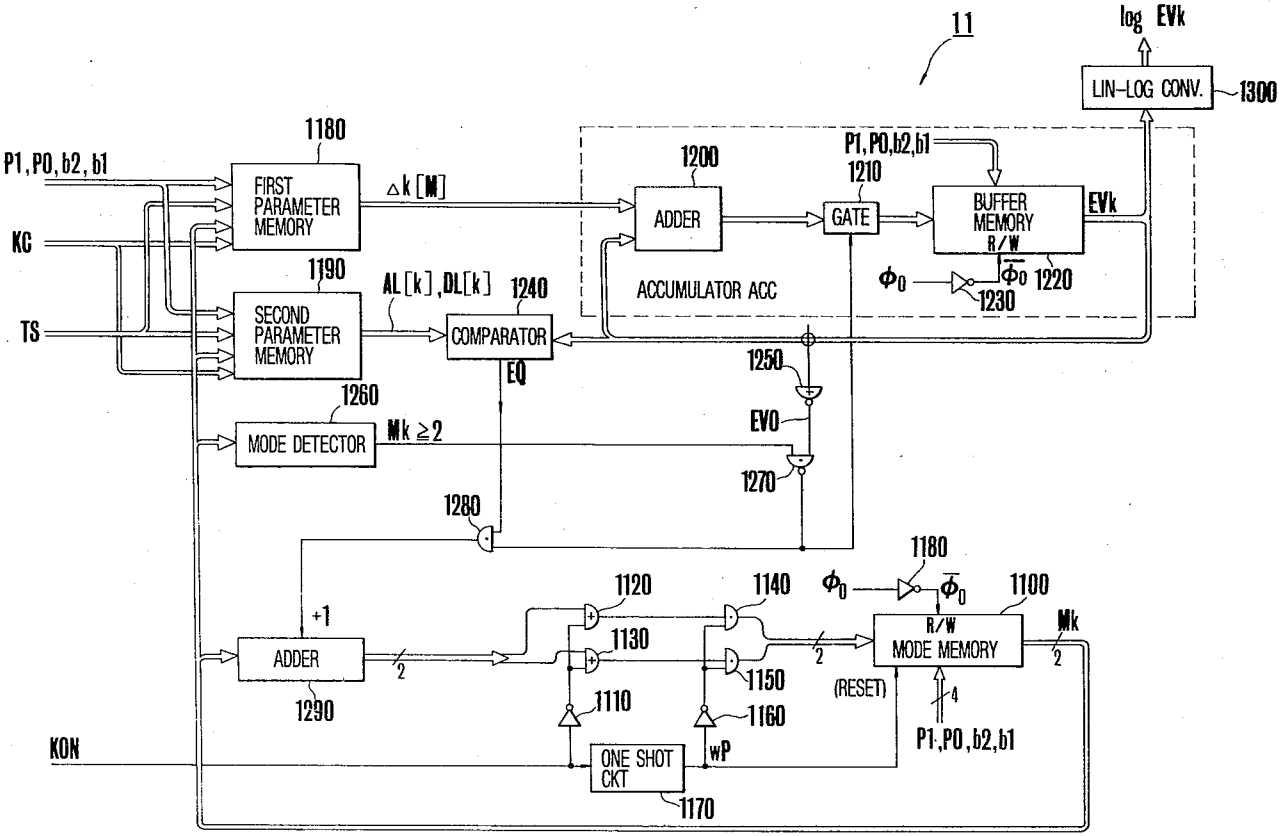
FIG. 11 is a block diagram showing the detail of an envelope generator shown in FIG. 1.
Figure 12:
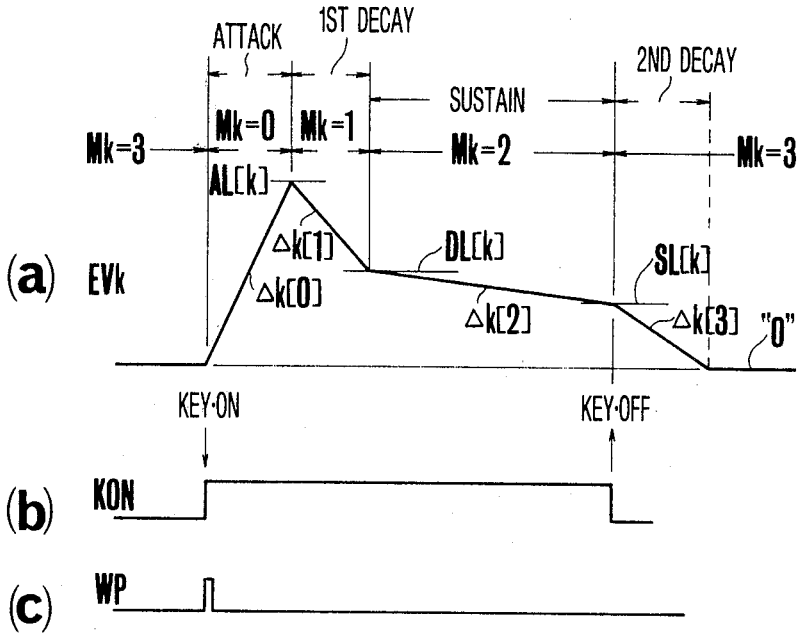
FIGS. 12*a–c* show one example of an envelope signal waveform and related control signal waveforms.

The detail of the circuit construction of the envelope generator 11 shown in FIG. 11 which forms envelope signals EVk (EV1 through EV40) for respective frequency signals (H1 through H40 shown in FIG. 5) and outputs the signals EVk thus formed in synchronism with the calculating timings of respective partial tone signals. As typified by the waveform of FIG. 12(*a*), each one of the envelope signals EVk comprises 4 envelope segments of an attack, a first decay, a sustain, and a second decay. Such envelope signal EVk is formed by sequentially accumulating, at a predetermined speed, the information Δk[M] representing the increments (at the time of attack) in each segment of the signal EVk applied for each frequency signal or decrements (at the time of the first decay, the sustain and the second decay), where M represents the types of the segments. In this embodiment attack is represented by "0", the first decay "1", the sustain by "2", and the second decay by "3". However, the waveforms of respective signals are different depending upon the tone colors and correspond to tone colors set by the tone color setter 8. For this reason the information Δk[M] and a decay level information DL[k] are determined for respective frequency signals corresponding to the set tone colors.

For example, the sequential accumulation of the increment information Δk[0] is continued until the accumulated value Δk[0] of the increment information Δk[0] comes to coincide with the attack level information Al[k] of the signal EVk given at each frequency signal corresponding to the set tone color.

The sequential accumulation of the decrement information Δk[1] of M=1 in a segment of the first decay is continued until the difference "Al[k]−ΣΔk[1]" between the attack level information Al[k] and the accumulated value ΣΔk[1] of Δk[1] coincides with the decay level information DL[k] of the signal EVk. Further the sequential accumulation of the decrement information Δk[2], in which M=2, of a sustain segment is continued until the key-on signal KON builds down. The sequential accumulation of the decrement information k[3], in which M=3, in a segment of the second decay is continued until the difference "SL[k]−ΣΔk[3]" between the sustain level SL[k] at a key-off point and the accumulated value ΣΔk[3] of Δk[3] becomes "0".

In FIG. 11, each of the first parameter memory device 118 and the second parameter memory device 1190 has a plurality of memory blocks designated by the tone color setting signal TS and the key code KC respectively. Each of these memory blocks MB stores and increment (or decrement) information Δk[M] (Δk[0] through Δk[3]), or an attack level information AL[k], and a decay level information DL(k) which are used to form an envelope signal EVk regarding frequency signals Hk respectively calculated at respective phase portion ph1 through ph4 of respective calculating channels. The selective designation of Δk[0] through Δk[3] acting as the information Δk[M] stored in the memory device 1180 and the selection and designation of informations AL(k) and DL(k) stored in the memory device 1190 are performed by the segment information Mk. The mode memory device 1100 includes memory addresses designated by slot number signals b2 through b1 and phase designation signals p2 through p1, and each memory address stores a segment information Mk respresenting a segment now being calculated of the signal EVk regarding respective frequency signals Hk.

A mode memory device 1100 has memory addresses designated by the slot number signals b2 and b1 and the phase designation signals P2 and P1, and storing segment informations Mk representing segments being calculated of the signals EVk regarding respective frequency signals. At the time of key-off all segment informations of the signals EVk regarding respective frequency signals are "3". Because the key-on signal KON becomes "0" when a depressed key is released whereby the output of an inverter 1110 becomes "1" with the results that both outputs of OR gate circuits 1120 and 1130 become "1" and this signal "11" ("3" according to the decimal representation) is applied to the mode memory device 1100 as a segment information of Mk=3 to be written therein according to a clock signal Φo given by an inverter 1180.

Under these state, when the key-on signal KON becomes "1" due to a key depression, a narrow width one shot pulse WP would be outputted from an one shot circuit 1170 in synchronism with the building up of the key-on signal KON as shown in FIGS. 12*b* and 12*c*. This one shot pulse WP is inverted by an inverter 1160 and then supplied to AND gate circuits 1140 and 1150 as an inhibition signal and to the mode memory device 1100 as a reset signal for resetting all stored informations. Accordingly, segment informations of Mk=3 stored in all addresses of the mode memory device 1100 are reset to become Mk=0.

When the segment information Mk outputted from the mode memory device 1100 becomes "0", the first and second parameter memory devices 1180 and 1190 produce increment informations Δk[0] and attack informations AL[k] regarding attacks for respective frequency signals corresponding to the tone color setting information TS in synchronism with the calculating time slots of the frequency signals. The increment information Δk[0] regarding the attack for each frequency signal is sequentially accumulated in an accumulator ACC comprising an adder 1200, a gate circuit 1210, a buffer memory device 1220 and an inverter 1230 in each DAC cycle (see FIG. 2).

More particularly, the buffer memory device 1220 has memory addresses designated by signals b2, b1 P1 and P0 in the same manner as the mode memory device 1100. These addresses store the successively accumulated values ΣΔk[M] of respective DAC cycle of the information Δk[M] and output these sequentially accumulated values ΣΔk[M] as the present amplitude values of the envelope signal EVk. When an increment signal Δk[0] of each frequency signal regarding the attack is applied to one input of the adder 1200, the increment signal k[0] is added to the accumulated value ΣΔk[0] of a corresponding frequency signal read out from the buffer memory device 1220 to form a new accumulated value "ΣΔk[0]+k[0]" which is written into the buffer memory device 1220 through the gate circuit 1210. In this case the accumulated values ΣΔk[0] regarding the attacks of the frequency signals outputted from the buffer memory device 1220 are all zero in the early stage. Accordingly, subsequent to the generation of a key-on signal due to a key-depression, the accumulated values ΣΔk[0] regarding the attacks of respective frequency signals gradually increases from zero as shown in FIG. 12*a*, and the rate of increase with the value of the increment information Δk[0].

As above described the envelope signals EVk regarding attack segments are independently formed for respective frequency signals and the accumulated values ΣΔk[0] of respective frequency signals are constantly compared with the attack level informations Al[k] for respective frequencies with a comparator 1240. When the result of comparison shows that ΣΔk[0]=AL[k], the comparator 1240 produces a coincidence signal EQ showing that the accumulated value ΣΔk[0] of a given frequency signal has reached an attack level. This coincidence signal EQ is supplied to one input of an AND gate circuit 1280 with the other input supplied with a signal "1" because the segment information Mk does not satisfy a relation Mk≧2 (since the output of the mode detector 1260 is "0", the output of the NAND gate circuit 1270 is "1"). Consequently, the coincidence signal EQ is applied to the "+1" input of an adder 1290 via the AND gate circuit 1280 with the result that the adder 1290 adds "+1" to the segment information Mk=0 regarding a frequency signal in which "ΣΔk[0]=AL[k]". The result of the addition operation is applied to the mode memory device 1100 via OR gate circuits 1120, 1130 and AND gate circuits 1140 and 1150 so that the segment information Mk in the mode memory device 1100 regarding the frequency signal which has changed to "ΣΔk[0]=Al[k]" would be updated to Mk=1. Thereafter, the accumulation operatiion is executed base on the decrement information Δk[1] regarding the decay of the first decay.

More particularly, when the segment information Mk outputted from the mode memory device 1100 is updated from Mk=0 to Mk=1, the first and second parameter memory devices 1180 and 1190 would output a decrement information Δk[1] (a negative value)regarding the segment of the first decay and a decay level information DL[k] respectively. Then the accumulator ACC made up of the adder 1200, the gate circuit 1210, the buffer memory device 1220 and the inventer 1230 sequentially adds to negative decrement information Δk[1] to the accumulated value ΣΔk[0] (=AL[k]) which is obtained when the attack level is reached in each DC cycle with the result that the accumulated value ΣΔk[1] at the segment of the first decay decreases gradually, such gradually decreasing accumulated value ΣΔk[1] being normally compared with a decay level information DL[k] in the comparator 1240. When the result of comparison becomes "ΣΔk[1]=DL[k]" a coincidence signal EQ is produced from the comparator 1240. At this time, since the segment information Mk does not satisfy a relation Mk≧2, the coincidence signal EQ outputted from the comparator 1240 is applied to "+1" input of the adder 1290 through AND gate circuit 1280, whereby the adder 1290 adds "+1" to the segment information Mk=1 regarding the frequency signal which become "ΣΔk[1]=DL[k]". The result of addition is applied to the mode memory device 1100 via OR gate circuits 1120, 1130 and AND gate circuits 1140, 1150 as an information write signal. Thus the segment information Mk in the mode memory device 1100 regarding a frequency signal which became "ΣΔk[0]=DL[k]" would be updated to Mk=2. Thereafter, the accumulation operation is ececuted based on a decrement information Δk[2] regarding the segment of the sustain.

More particularly, when the segment information Mk outputted from the mode memory device 1100 is updated to Mk=2 from MK=1, the first parameter memory device 1180 would produce a decrement informations (a negative value) regarding the segment of the sustain. Then, in the accumulator ACC, the negative decrement information Δk[2] is sequentially added to the accumulated value ΣΔk[1] obtainable when a first decay level DL[k] is reached in each DAC cycle, whereby the accumulated value ΣΔk[2] in the sustain segment decreases successively. During each accumulation operation, when the key-on signal becomes "0" as a result of key release, the inverter 1110 applies a signal "1" to the OR gate circuits 1120 and 1130. Then the signals "1" outputted therefrom are inputted to the mode memory device 1100 via AND gate circuits 1140 and 1150 as the information write signal. Accordingly, the segment information Mk is updated to Mk=3 from Mk=2. Thereafter, the accumulation operation proceeds based on the decrement information Δk[3] regarding the second decay segment.

Although the accumulation operation regarding the second decay information is executed in the same manner as above described it is completed when the accumulated value ΣΔk[3] becomes zero.

More particularly, when the accumulated value ΣΔk[3] becomes zero a detection signal EVO indicating this fact is outputted from the NOR gate circuit 1250. At this time, since the segment information becomes Mk=3, a mode detector 1260 produces a signal "1" showing that Mk≧2. Accordingly, the output signal of the NAND gate circuit 1270 becomes "0" to disenable the AND gate circuit 1210 of the accumulator ACC. Consequently, the accumulation operation regarding the frequency signal which became ΣΔk[3]=0 is stopped.

Where the decrement information Δk[2] regarding a sustain segment has a large value the accumulated value ΣΔk[2] may became zero before the key-on signal KON becomes "0". Even in such a case, a signal "0" is applied to the gate circuit 1210 from the NAND gate circuit 1270 thus stopping the accumulation operation. In this case, the segment information is updated to Mk=3 when the key-on signal KON becomes "0".

The accumulated values ΣΔk[0], ΣΔk[1], ΣΔk[2], and ΣΔk[3] respectively regarding the segments of the attack, first decay, sustain, and the second decay for each frequency signal which are formed as above described are converted into logarithmic values by a logarithm converter 1300 and then outputted as envelope signals log Evk in synchronism with the calculating timings of respective frequency signals thereby setting different amplitudes of the envelope waveform for respective frequency signals.

Figure 13:
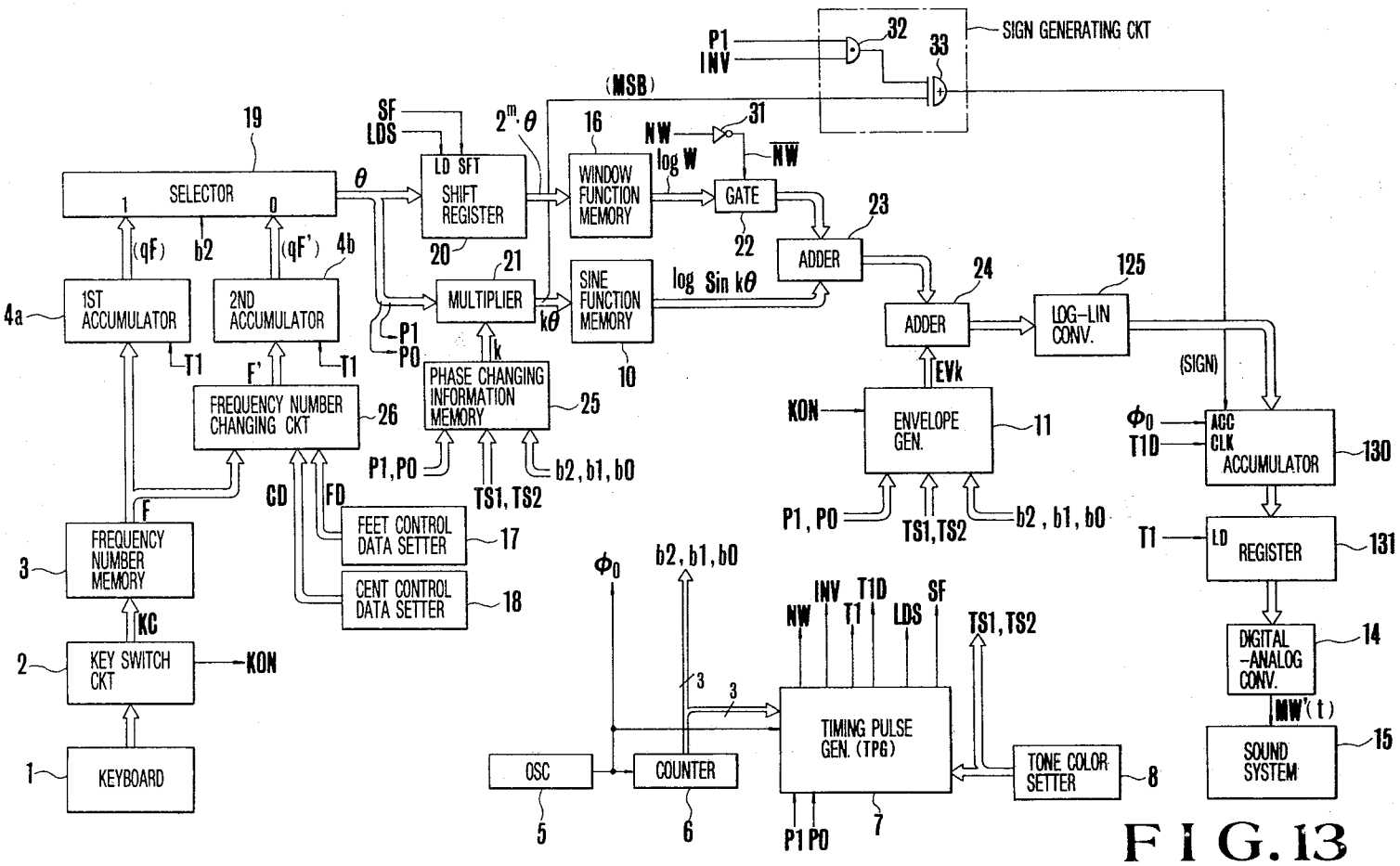
FIG. 13 is a block diagram showing another embodiment of the electronic musical instrument according to this invention.

FIG. 13 is a block diagram showing another embodiment of the electronic musical instrument according to this invention, which comprises 8 time divisioned time slots ts0 through ts7 similar to the electronic musical instrument shown in FIG. 1 but differs therefrom in the following points.

(a) That the time window signal W and the frequency signal Hk are produced by independent function memory devices and that the partial tone components in a predetermined frequency bandwidth are independently calculated in respective time slots ts0 through ts7 and (b) That the time slots ts0 through ts7 are divided into a first group comprising ts0 through ts3 and a second group comprising ts4 through ts7 so as to enable these groups to form independent musical tone signals having different pitches and tone colors.

Figure 14:
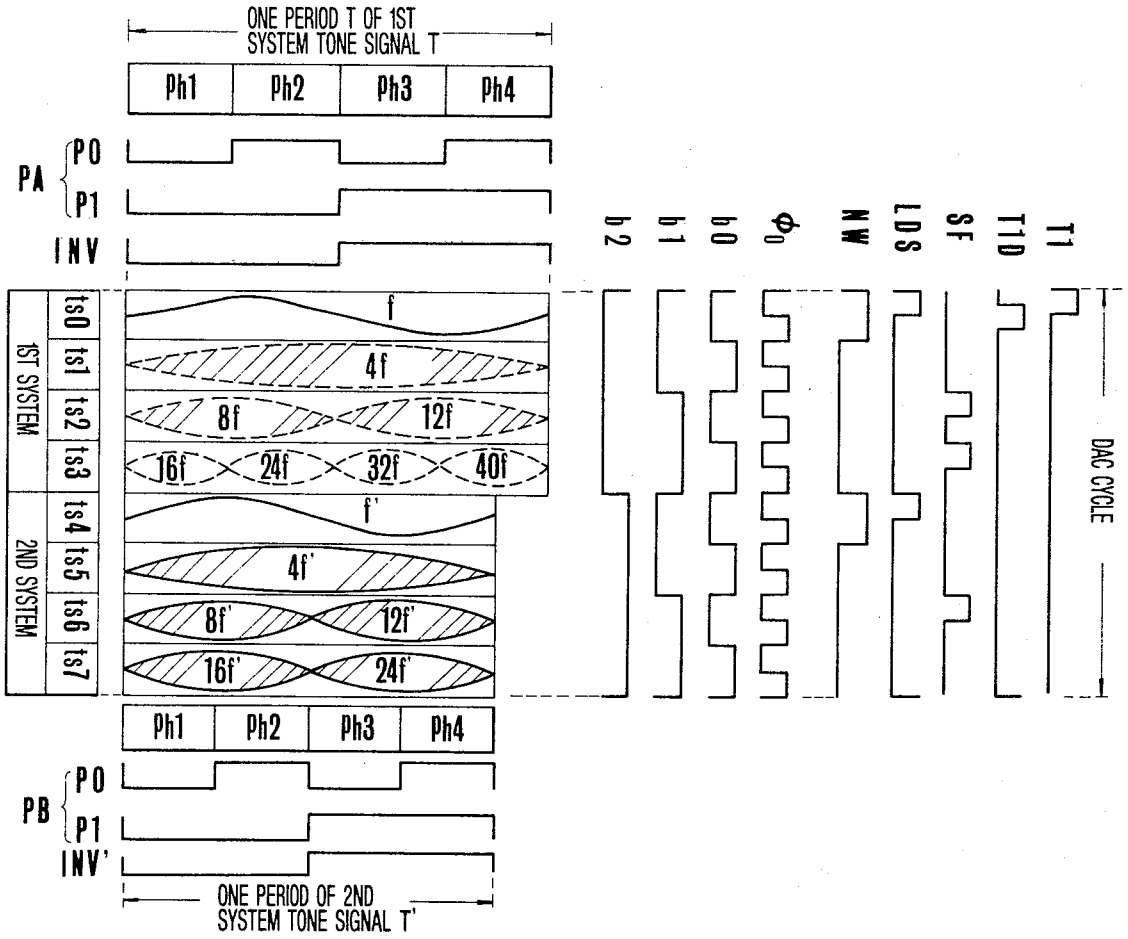
FIG. 14 is a graph showing the time relation between a partial tone signal formed by the electronic musical instrument shown in FIG. 13 and the timing pulse.

More particularly, in the first time slot groups ts0 through ts3 as shown in FIG. 14, the first order partial tone signal h1 having a frequency of f1 is calculated in the time slots ts0. In the time slot ts1, a plurality of partial tone signals h4w having the fourth order partial tone signal h4 as the center component are calculated by multiplying the frequency signal H4 having a frequency of 4f with a Hanning window signal HW having a time width TW of T(=1/f), in the time slot ts2, the frequency signal Hs having a frequency of 8f as the center component is multiplied with a time window signal W having a time width TW of (½)T in the forehalf of one period T(=/f) of the musical tone signal to calculate a plurality of partial tone components h12w having the 12th order partial tone component h12 as the center component. In the time slot ts3, one period T(=1/f) of the musical tone signal is divided into 4 parts and in each ¼ period, a time window signal W having a time width TW of (¼)T is multiplied respectively with frequency signals H16, H24, H32 and H40 respectively having frequencies of 16f, 24f, 32f and 40f to form a plurality of partial tone components h16w, h24w, h32w and h40w respectively having center frequencies of the 16th order partial tone components h16, the 24th order partial tone components h24, the 32th order partial tone component h32, and the 40th order partial tone component h40.

In the second group time slots ts4 through ts7, the frequency signals H'k having frequencies as shown in the following Table XXI are multiplied with time window signals W' to calculate a plurality of partial tone components h4w', h8w', h12w' and h24w' having the first order partial tone signal h1' (of a frequency of f') and the fourth order partial tone signal h4' (having a frequency of 4f'), the 8th order partial tone signal h8' (having a frequency of 8f'), the 12th order partial tone signal h12' (having a frequency of 12f'), the 16th order partial tone signal h16' (having a frequency of 16f') and the 24th order partial tone signal h24' (having a frequency of 24f') as their center components, where the frequency f' is slightly different from the normal frequency f of the fundamental wave corresponding to the tone pitch of a depressed key.

TABLE XXI

| time slot | frequency of partial tone signal | time width WT of Hanning window signal HW, where T' = 1/f' | Partial tone signal to be calculated |
|---|---|---|---|
| ts 4 | f' | no window signal | h1' |
| ts 5 | 4 f' | (T') | h4 w' |
| ts 6 | | | |
| fore half | 8 f' | (½) × (T') | h8 w' |

TABLE XXI-continued

| time slot | frequency of partial tone signal | time width WT of Hanning window signal HW, where T' = 1/f' | Partial tone signal to be calculated |
|---|---|---|---|
| later half | 12 f' | (½) × (T') | h12 w' |
| ts 7 | | | |
| fore half | 16 f' | (½) × (T') | h16 w' |
| later half | 24 f' | (½) × (T') | h24 w' |

The partial tone signals calculated in the first group time slots ts0 through ts3 and the second group time slots ts4 through ts7 are synthesized at each one cycle of the time slots ts0 through ts7 (that is one DAC cycle) to be converted into an analogue synthesized musical tone signal. Consequently, with the electronic musical instrument of this embodiment it is possible to obtain a performance tone composed of two musical tones having slightly different tone pitches and different tone colors. In this case, the tone colors of the musical tone signals formed in respective groups are arbitrarily selected and since the tone pitch of the musical tone signal formed by the second group can be set to any value, performance tones rich in variety can be produced.

The construction of the circuit shown in FIG. 13 will now be described, in which elements corresponding those shown in FIG. 1 are designated by the same reference charactors.

In the same manner as in FIG. 1, a timing pulse generator 7 produces various timing pulses necessary to calculate various partial tone signals. In this embodiment, the timing pulse generator 7 generates timing pulses NW, INV, T1, TID, LDS and SF. Of these, the timings of generations and the number of generations of the timing pulses NW, INV and SF are different depending upon the tone color set by the tone color setter 8. More particularly, the timing pulse NW becomes "1" when only one partial tone signal is calculated without using the time window signal W. Accordingly, when calculating only one partial tone signal with the time slot ts0 of the first group, the timing pulse NW becomes "1" in the time slot ts0.

Accordingly, where only a single partial tone component is to be calculated in the time slot ts0 of the first group as shown in FIG. 14, for example, the timing pulse NW becomes "1" only in the time slot ts0. When even numbered order partial tone components are eliminated from the musical tone signals formed in respective groups so as to form musical tone signals consisting of only the odd number ordered partial tone components, the timing pulse INV becomes "1" in the later halves of one periods T and T' of respective musical signals. Accordingly, where a tone color of a musical tone made up of partial tone components of the even and odd number orders is selected, this timing pulse INV is normally "0". However, in some cases, this pulse is different in the first and second groups.

The timing pulse SF corresponds to the timing pulse SFT outputted from the AND gate circuit 92 shown in FIG. 1, and is used to form timing window signals W having time width Tw of (½)T and (¼)T (in the second group (½)T' and (¼)T') by shifting one bit towards the upper bit respective bits of the phase designation signal loaded in the shift register 20. As a consequence, the timing of generation and the number m of generations of this timing pulse SF vary depending upon the assignment of the partial tone components to be calculated in respective time slots and the time width Tw of the time window signal W. The timing pulse LDS is used to load the phase designation signals $\theta$(=wt, wt') of respective groups in the shift register 20.

The frequency number changing circuit 26 functions to change the frequency number F outputted from the frequency number memory device 3 in accordance with a feet data FD set by the feet control data setter 17 and a cent control data CD set by the cent control data setter 18 and then outputs the changed frequency number as a frequency number F' which is accumulated in the accumulator **4*b* of the second group at the period of generation of the timing pulse T1. The feet data FD and the cent data CD are used to change the pitch of a musical tone signal formed in the second group with respect to the musical tone of the first group. The accumulated value qF' (q=1, 2 . . . ) obtained by the second group accumulator 4*b* is supplied to a selector 19 as a phase designation signal wt' that designates the phase of a sampling point in one period of the musical tone signal of the second group, so that the selector 19 selects and outputs a signal $\theta$ in a period between time slots ts4 through ts7 in which the slot number signal b2 is "1". On the other hand, a frequency number corresponding to the tone pitch of a depressed key is generated in a period of generation of the timing pulse T1 by the first group accumulator 4*a*. The accumulated value is applied to a selector 19 to act as a phase designation signal wt that designates respective sampling point phases of one period T of the musical tone signal produced by the first group, whereby the selector 19** selects and outputs a signal $\theta$ in a period of the time slots ts0 through ts3 in which the slot number signal b2 is "0". In this case, the repetition frequencies of the phase designation signals wt and wt' of the first and second groups respectively coincide with the frequencies of the musical tones to be formed in respective groups.

The phase changing information memory device 25 functions to change the phase designation signal $\theta$ (wt and wt') in accordance with the frequencies of respective frequency signals Hk to be generated, but the phase changing memory device 25 of this embodiment is constructed such that it produces predetermined phase changing informations k for respective groups in accordance with the tone colors set for respective groups. This phase changing information memory device 25 has n (an integer) memory blocks MB1 through MBn corresponding to n types (sum of the first and second groups) of tone colors that can be set with the colors that can be set with the color setter 8. Among these memory blocks, the addresses designated by the most significant bit p1 of the phase designation signal (wt and wt'), the next order bit p0 and the slot number signals b2, b1 and b0 store the phase changing informations k corresponding to the set tone colors of respective groups. As a consequence, when tone color setting informations Ts1 and Ts2, the upper order two bit signals p1 and p0 of the phase designation signal $\theta$ and the slot number signals b2 through b0 are supplied to such phase changing information memory device 25 as address signals, the phase changing informations k corresponding to the tone color setting informations TS1 and TS2 would be outputted at each time slot of respective groups at respective phase portions of one period of a musical tone signal designated by signals p2 and p0.

Consequently, changing the phase designation signals $\theta$ (wt and wt') outputted from the selector 19 based on the phase changing informations k corresponding to the set tone colors of respective groups with the multiplying action of the muliplier 21 and then by applying the phase designation signals k thus changed to the sine function memory device 10 to act as address signals, the sine function memory device 10 would produce a frequency signal Hk [=log sin k$\theta$] having a frequency corresponding to the signal k$\theta$. It can be noted that, in this embodiment, as the multiplying operation is effected at a high speed, the sine amplitude values at respective sampling points of one period of a sine waveform to be stored in the sine function memory device 10 will take the form of logarithmic sine amplitude values log (sin k$\theta$).

Figure 15:
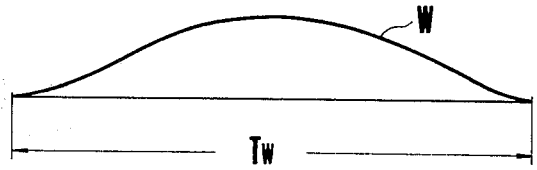
FIG. 15 shows a stored waveform of a window function memory shown in FIG. 13.

The shift register 20 functions to change the phase designation signals $\theta$ (wt and wt') according to the time widths Tw of the time window signals W respectively assigned to the time slots ts0 through ts3 of the respective groups and to apply the signals thus changed (window phase designation signals) to the window function memory device 16 to act as the address signals. The timing pulses SF that shift one bits towards upper orders respective bits of the phase designation signals $\theta$ (wt and wt') loaded in the shift register in the first time slots ts0 and ts4 of respective groups have different generation timings and number of generations m according to the set tone colors of respective groups as has already been pointed out hereinabove. Consequently, the shift register 20 outputs window phase designation signals $(2^m)\times(\theta)$ corresponding to the set tone colors at respective time slots ts0 through ts7. At this time, the window function memory device 16 is storing logarithmic window signal amplitude values at respective sampling points of a time window signal W having a waveform as shown in FIG. 15. Then, the window function memory device 16 outputs logarithmic window signal amplitude values log W. For this reason, when the sine amplitude value log (sin k$\theta$) in terms of logarithm is multiplied with a window signal amplitude value log W by an addition operation, then the amplitude envelope is set by an addition operation, and thereafter by converting the amplitude envelope thus set into a natural number, it is possible to calculate respective partial tone components in the same manner as the case shown in FIG. 1. Reference numerals 23 and 24 shown in FIG. 13 designate adders for executing such arithmetic operations, while 125 designates a logarithm-natural number converter which converts a logarithmic value into a natural number. Where a given slot time such as the slot time ts0 of the first group or the time slot ts4 of the second group shown in FIG. 14 is used to calculate a single partial tone component, a gate circuit 22 provided between the window function memory device 16 and the adder 23 is disabled by a signal NW formed by inverting the timing pulse NW with an inverter 31. At this time, a signal log W=0 is applied to the adder 23.

The electronic musical instrument having a construction as above described operates as follows.

After closing a source switch, not shown, the counter 6 and the timing pulse generator 7 output slot number signals b2, b1 and b0 and timing ulses T1 and TID as shown in FIG. 14. Under these states, when desired, tone colors are set for respective groups with the tone color setter 8, the timing pulse generator 7 would produce timing pulses NW, LDS.SF, and INV corresponding to the set tone colors of respective groups, as shown in FIG. 14. Desired feet data FD and cent data CD are set with the feet control data setter 17 and the cent control data setter 18, and thereafter when a key of the keyboard 1 is depressed, a frequency number F corresponding to the tone pitch or note of the depressed key is read out from the frequency number memory device 3. This read out frequency number F is applied to the first accumulator 4*a* as it is and changed into a frequency number F' slightly different from the depressed key tone pitch by the changing circuit 6 according to the feet data FD and the cent data CD, and the frequency number F' thus changed is supplied to the accumulator 4*b* of the second group. Then, this accumulator 4*b* sequentially accumulates the frequency number F' at the period of generation of the timing pulse T1 to produce an accumulated value qF' whose recurrent frequency is the same as the frequency f' of the musical signal to be formed in the second group, the accumulated value qF' serving as the phase designation signal wt' of the second group. On the other hand, the first group accumulator 4*a* sequentially accumulates the frequency number F corresponding to the tone pitch of the depressed key at a period of generation of the timing pulse T1 to produce an accumulated value qF as the phase designation signal wt for the first group, the recurrent frequency of the accumulated value being the same as the frequency f of the musical tone signal to be formed in the first group. These phase designation signals wt and wt' of the first and second groups are selected and outputted, on the time division basis, from the selector 19 according to the slot number signal b2 in the fore and later have of the 8 time slots ts0 through ts7. More particularly, in the time slots ts0 through ts3, the selector 19 produces a phase designation signal wt acting as a signal $\theta$ regarding the first group, while in the time slots ts4 through ts7, the selector 19 produces a phase designation signal wt' acting as the signal $\theta$ regarding the second group. The phase designation signal $\theta$ outputted from the selector 19 is changed by the multiplier 21 and the shift register 20 in accordance with the frequencies of the frequency signals Hk to be produced in respective time slots ts0 through ts7 and the time width Tw of the time window signal W. More particularly, where the partial tone components to be calculated in respective time slots ts0 through ts7 are shown in FIG. 14, the phase change information memory device 25 produces phase change informations k as shown in the following Table XXII in respective time slots ts0 through ts7 designated by respective phase portions ph1 through ph4 of one period of the musical tone signal designated by the upper two bit signals p1 and p0 of the phase designation signal $\theta$, and by the slot number signals b2, b1 and b0, the outputted phase change information signal k being supplied to the multiplier 21. Accordingly, the phase designation signal outputted by the selector 19 is changed into a signal by the multiplier 21, the recurrent frequency of the signal coinciding with the frequencies of frequency signals Hk to be produced in respective time slots ts0 through ts7.

TABLE XXII

| | phase component | | | time slot | | | | phase changing |
|---|---|---|---|---|---|---|---|---|
| | p1 | | p0 | b2 | b1 | b0 | ts | information k |
| first | 0 | | 0 | 0 | 0 | 0 | ts0 | k = 1 |
| group | | (ph1) | | 0 | 0 | 1 | 1 | = 4 |
| | | | | 0 | 1 | 0 | 2 | = 8 |
| | | | | 0 | 1 | 1 | 3 | = 16 |
| second | | | | 1 | 0 | 0 | 4 | = 1 |
| group | | | | 1 | 0 | 1 | 5 | = 4 |
| | | | | 1 | 1 | 0 | 6 | = 8 |
| | | | | 1 | 1 | 1 | 7 | = 16 |
| first | 0 | | 1 | 1 | 0 | 0 | ts0 | k = 1 |
| group | | (ph2) | | 1 | 0 | 1 | 1 | = 4 |
| | | | | 1 | 1 | 0 | 2 | = 8 |
| | | | | 1 | 1 | 1 | 3 | = 24 |
| second | | | | | | | 4 | = 1 |
| group | | | | | | | 5 | = 4 |
| | | | | | | | 6 | = 8 |
| | | | | | | | 7 | = 16 |
| first | 1 | | 0 | 1 | 0 | 0 | ts0 | k = 1 |
| group | | (ph3) | | 1 | 0 | 1 | 1 | = 4 |
| | | | | 1 | 1 | 0 | 2 | = 12 |
| | | | | 1 | 1 | 1 | 3 | = 32 |
| second | | | | | | | 4 | = 1 |
| group | | | | | | | 5 | = 4 |
| | | | | | | | 6 | = 12 |
| | | | | | | | 7 | = 24 |
| first | 1 | | 1 | 1 | 0 | 0 | ts0 | k = 1 |
| group | | (ph4) | | 1 | 0 | 1 | 1 | = 4 |
| | | | | 1 | 1 | 0 | 2 | = 12 |
| | | | | 1 | 1 | 1 | 3 | = 40 |
| second | | | | | | | 4 | = 1 |
| group | | | | | | | 5 | = 4 |
| | | | | | | | 6 | = 12 |
| | | | | | | | 7 | = 24 |

The phase designation signal k $\theta$ outputted from the multiplier 21 is applied to the sine function memory device 10 as an address signal so that sinewave amplitude values log (sin k $\theta$) having frequencies as shown in the following Table XXIII would be read out from the sine function memory device 10.

TABLE XXIII

| | time slot | | frequency of log sin k $\theta$ |
|---|---|---|---|
| first group | ts 0 | | f1 |
| | ts 1 | | 4f1 |
| | ts 2 | p1 = 0 | 8f1 |
| | | p1 = 1 | 12f1 |
| | ts 3 | p1, p0 = 0,0 | 16f1 |
| | | = 0,1 | 24f1 |
| | | = 1,0 | 32f1 |
| | | = 1,1 | 40f1 |
| second group | ts 4 | | f'1 |
| | ts 5 | | 4f'1 |
| | ts 6 | p1 = 0 | 8f'1 |
| | | = 1 | 12f'1 |
| | ts 7 | p1 = 0 | 16f'1 |
| | | = 1 | 24f'1 |

The shift register 20 is loaded with the phase designation signal $\theta$ outputted from the selector 19 each time a timing pulse LDS for each group is generated, and the loaded signal is shifted toward a upper order bit each time the timing pulse SF is generated for producing a window phase designation signal $2^m \times \theta$ having a period corresponding to the time width Tw of the time window signal W assigned to each one of the time slots ts0 through ts7. As a consequence, time window signal amplitude values log W having time widths as shown in the following Table XXIV are read out from the window function memory device 16.

TABLE XXIV

| | time slot | | time width Tw of log W |
|---|---|---|---|
| first group | ts 0 | | T |
| | ts 1 | | T |
| | ts 2 | p1 = 0 | (½)T |
| | | = 1 | (½)T |
| | ts 3 | p1, p0 = 0,0 | (¼)T |

TABLE XXIV-continued

| | time slot | | | time width Tw of log W |
|---|---|---|---|---|
| | | | = 0,1 | " |
| | | | = 1,0 | " |
| | | | = 1,0 | " |
| second group | | ts 4 | | T' |
| | | ts 5 | | T' |
| | ts 6 | p1 | = 0 | (½)T' |
| | | | = 1 | " |
| | ts 7 | p1 | = 0 | (½)T' |
| | | | = 1 | " |

A sine amplitude value log (sin k $\theta$) read out from the sine function memory device 10 and a window signal amplitude value log W outputted from the window function memory device 16 and relating to the same time slot are multiplied with each other by an addition operation. In the example shown in FIG. 14, since the timing pulses NW are "1" in the time slot ts0 of the first group and in the time slot ts4 of the second group, a signal [log W=0] is applied to the adder 23. For this reason, in time slots ts0 and ts4, sine amplitude values log (sin k $\theta$) are outputted from the adder 23 as the partial tone components h1 and h1', while in the other time slots ts1 through ts3 and ts5 through ts7 a plurality of partial tone components h4w, h8w, h12w, h16w, h24w, h32w, h40w and h'4w, h'8w, h'12w, h'16w and h'24w over a predetermined bandwidth and having a frequency expressed by k $\theta$ as a center component are produced by multiplying the sine amplitude value log (sin k $\theta$) with the window signal amplitude value log W.

After being imparted with corresponding amplitude envelopes by the adder 24, the partial tone components of respective groups calculated in a manner described above are synthesized by the accumulator 136 at each cycle. The synthesized signal is then transferred to the register 131 and then converted into an analogue synthesized musical tone signal Mw'(t) by the digital-analogue converter 14. Finally the analogue musical tone signal is produced as a musical tone through the sound system 15. In this case, the frequency of a musical tone signal (formed by synthesizing the partial tone signals calculated in the time slots ts0 through ts3) formed by the first group is different from the frequency of a musical tone signal (formed by synthesizing partial tone components calculated in the time slots ts4 through ts7) formed by the second group, and the constituent components of these two musical tone signals are also different. For this reason, the electronic musical instrument according to this embodiment can produce a performance tone as if two electronic musical instruments having different tone pitches and different tone colors were performed simultaneously.

In this embodiment, it is also possible to cause two musical tone signals formed by the first and second groups to have the same tone pitch but different tone colors, or to have the same tone colors but different tone pitches.

Although in the foregoing embodiment, the sine wave signal log (sin k $\theta$) and the window signal log W are prestored in memory devices, it is also possible to form these signals by arithmetic operations.

Furthermore, instead of controlling the time width Tw of the time window signal W by changing the period of the phase designation signal $2^m \times \theta$ with a shift register, it is also possible to control the time width Tw with the phase change information k in the same manner as in a case of forming the phase designation signal k $\theta$.

Furthermore, the time window signal is not limited to a Hanning window signal, and a square window signal, Hamming window signal, a Gaussian window signal or Dolph Chebyshev window signal can also be used.

Further, the frequency of a frequency signal to be calculated is not limited a perfect integer ratio but may be slightly different therefrom, in which case a nonharmonic musical tone signal is obtained. To this end the phase changing information k is set to a value slightly different from an integer. Thus for example, k=2,001.

It should also be understood that the number of the time slots for calculating the partial tone components may be suitably increased or decreased.

As above described, in the electronic musical instrument embodying the invention, where a plurality of partial tone components in a predetermined frequency bandwidth are simultaneously calculated by amplitude modulating a frequency signal having a predetermined frequency, there is provided a designating means which designates the frequency of a frequency signal produced by frequency signal generating means and the time width of a time window signal generated by time window signal generating means for setting the frequency of the frequency signal and the time width of the time window signal at any desired values. For this reason, it is possible to freely select the frequency bandwidth of the calculated partial tone components thereby producing a musical tone having a variety of tone colors.

What is claimed is:

1. An electronic musical instrument of the type in which a musical tone is synthesized from a plurality of windowed partial tone components, comprising:

time window signal generating means for separately generating for each of said windowed partial tone components a time window signal having a time width;

frequency signal generating means for separately generating for each of said windowed partial tone components a frequency signal having a frequency;

tone color setting means for setting a tone color selected among a plurality of tone colors;

control means connected to said tone color setting means for determining said time widths of said time window signals generated by said time window signal generating means and said frequencies of said frequency signals generated by said frequency signal generating means in accordance with the set tone color;

modulating means for amplitude modulating each frequency signal with the time window signal for the corresponding windowed partial tone component and for combining the resultant modulated signals to produce a combined signal containing a plurality of partial tone components whose frequencies are determined by said time widths and said frequencies; and sound system means for converting said combined signal to a musical tone.

2. An electronic musical instrument according to claim 1 wherein said control means comprises control signal generating means for generating a control signal in accordance with said set tone color, said time widths and said frequencies being determined by said control signal.

3. An electronic musical instrument comprising a plurality of windowed partial tone component calculating channels, including:

tone color setting means for setting a tone color selected among a plurality of tone colors, and for each channel;

time window signal generating means for generating a time window signal having a time width;

frequency signal generating means for generating a frequency signal having a frequency;

control means connected to said tone color setting means for determining said time width of said time window signal generated by said time window signal generating means and said frequency of said frequency signal generated by said frequency signal generating means for said each channel in accordance with the set tone color; and modulating means for amplitude modulating said frequency signal with said time window signal and for outputting a modulated signal for each channel, said modulated signal containing a plurality of partial tone components whose frequencies are determined by said time width and said frequency for the corresponding channel; together with:

synthesizing means for synthesizing a musical tone signal from the independent modulated signals from each calculating channel; and sound system means for converting the synthesized modulated signals to a musical tone.

4. An electronic musical element according to claim 3 wherein said control means comprises control signal generating means for generating a control signal in accordance with said set tone color, said time widths and said frequencies being determined by said control signal.

5. An electronic musical instrument of the type in which a musical tone is generated by computing successive sample point amplitudes of said tone at regular time intervals, said successive sample point amplitudes being established by a phase designation signal which is incremented in accordance with the fundamental frequency of the tone to be generated, comprising:

time division channel means for establishing a small plurality of time division channels corresponding in number to the number of windowed partial tone components which are to be included in each sample point computation, each channel being divided into two parts, in one of which the current value of a time window signal is calculated, said time window signal having a selectable with relationship with respect to a period of said fundamental frequency of the tone to be generated, in the other of which the current value of a frequency signal of selectable order is calculated, phase designation signal generator means, operative during said one part of each time division channel, for establishing the effective phase angle value of said time window signal and for establishing a trigonometric signal corresponding thereto, and operative during said other part of each time division channel, for establishing the effective phase angle value of a frequency signal having a frequency corresponding to said selectable order and for establishing a trigonometric signal corresponding thereto, arithmetic processing means, effective during each time division channel, for multiplying the established trigonometric signal for said time window signal by the established trigonometric signal for said frequency signal, and synthesizing means for accumulating the multiplication products for all channels to establish each computed sample point amplitude.

6. An electronic musical instrument according to claim 5 further comprising:

means responsive to said phase designation signal for establishing which portion of a period of said musical tone currently is being generated, and means for selectively altering the width of said time window signal and the order of said frequency signal in accordance with which portion of said period currently is being produced.

7. An electronic musical instrument according to claim 5 further comprising:

tone color designation means for separately establishing, for each of several portions into which each period of the musical tone being generated is divided, different values of selected time window signal width and frequency signal order.

8. An electronic musical instrument according to claim 5 wherein each of said trigonometric signals corresponding to said time window signal and to said frequency signal is a sinusoid signal represented in logarithmic form, and further comprising a doubler, operative during said one part of each time division channel, for doubling the logarithmic value of the sinusoid signal corresponding to said time window signal, thereby effectively obtaining a sine square time window signal shape.

9. An electronic musical instrument according to claim 5 further comprising:

an envelope generator producing a separate envelope imparting signal for each separate partial tone component, and wherein each multiplication product obtained by said arithmetic processing means is scaled by the envelope value of the envelope imparting signal for the corresponding partial tone component.

10. An electronic musical instrument of the type in which amplitude contributions of windowed partial tone components are computed at regular time intervals for successive sample points of the musical tone being generated, said sample points being designated by a phase designation signal which is incremented in accordance with the fundamental frequency of said musical tone, comprising:

first means, operative at each designated phase of the musical tone being generated, for separately evaluating, for each windowed partial tone component, a time window function of specifiable width and a frequency signal of sinusoidal waveform having a frequency corresponding to a selected partial tone component order, second means for arithmetically combining said time window function and said frequency signal, for each windowed partial tone component, to obtain the sample point amplitude contribution of said each component, said amplitude contributions of all components being combined to obtain said computed sample point amplitude at the designated phase, and third means for selecting, from among a preestablished group of such sets, the set of time window function widths and partial tone component orders which is used by said first means, thereby facilitating tone color selection.

11. In an electronic musical instrument, a system for synthesizing a musical tone from a set of windowed partial tone components, each of which comprises a sinusoidal frequency signal of selectable harmonic order modulated by a time window function, comprising:

first means, operative at each sample point of said musical tone, for separately evaluating for each windowed partial tone component (a) the effective amplitude at that sample point of a time window function having an independently selectable width, and (b) the effective amplitude of said sinusoidal frequency signal of selected order corresponding to that partial tone component, and second means for arithmetically combining, separately for each windowed partial tone component, said effective amplitudes of said time window function and said frequency signal to obtain the sample point amplitude contribution of said each windowed partial tone component, said contributions being accumulated to synthesize said musical tone.

12. An electronic musical instrument according to claim 11 wherein said selectable width is in integer or subinteger relationship to the fundamental period of said musical tone.

13. An electronic musical instrument according to claim 11 further comprising:

third means for designating to said first means the respective time window function width and frequency signal order separately for each windowed partial tone component, thereby to accomplish tone color selection for said musical tone.

* * * * *